US011579556B2

(12) United States Patent
Hashimoto et al.

(10) Patent No.: US 11,579,556 B2
(45) Date of Patent: Feb. 14, 2023

(54) IMAGE FORMING APPARATUS FOR PROLONGING LIFE OF REPLACEABLE IMAGE FORMING UNIT

(71) Applicant: CANON KABUSHIKI KAISHA, Tokyo (JP)

(72) Inventors: Kazunori Hashimoto, Shizuoka (JP); Bunro Noguchi, Shizuoka (JP); Keitaro Nakata, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/668,922

(22) Filed: Feb. 10, 2022

(65) Prior Publication Data

US 2022/0269214 A1 Aug. 25, 2022

(30) Foreign Application Priority Data

Feb. 19, 2021 (JP) ..... JP2021-025744

(51) Int. Cl.
*G03G 15/01* (2006.01)
*G03G 21/00* (2006.01)

(52) U.S. Cl.
CPC ..... *G03G 21/0058* (2013.01)

(58) Field of Classification Search
CPC ..... G03G 15/01; G03G 15/0121; G03G 15/0131; G03G 15/0178; G03G 15/0189
USPC ..... 399/298, 299, 302, 308
See application file for complete search history.

(56) References Cited

U.S. PATENT DOCUMENTS 8,583,004 B2 11/2013 Kamimura
10,754,273 B2 * 8/2020 Mochizuki et al. ..... G03G 15/0266
11,126,137 B2 * 9/2021 Kawashima ..... G03G 21/1676

FOREIGN PATENT DOCUMENTS

JP 2003-084538 A 3/2003
JP 2006-126591 A 5/2006
JP 2008-262131 A 10/2008
JP 2008-309905 A 12/2008
JP 2010-165000 A 7/2010
JP 2012-135963 A 7/2012

* cited by examiner

*Primary Examiner* — William J Royer
(74) *Attorney, Agent, or Firm* — Venable LLP

(57) ABSTRACT

An image forming apparatus includes first and second image forming portions and a belt. The first and second image forming portions include first and second image bearing members, and first and second transferring members, respectively. The belt nips and feeds a recording material. The first image forming portion is disposed upstream of the second image forming portion in a moving direction of the recording material, and a plurality of members including the first and second image bearing members are integrally assembled and are mountable on or dismountable from a main assembly of the image forming apparatus. A film thickness of a surface of the first image bearing member is larger than a film thickness of a surface of the second image bearing member, circumferential speed ratios or contact pressures of rotating components differ, and/or mass ratios of components of respective developers differ.

14 Claims, 8 Drawing Sheets

(a)

(b)

IMAGE FORMING APPARATUS FOR PROLONGING LIFE OF REPLACEABLE IMAGE FORMING UNIT

FIELD OF THE INVENTION AND RELATED ART

The present invention relates to an image forming apparatus, such as a printer, a multiple function machine, or a fax machine, of an electrophotographic type.

Conventionally, there is an image forming apparatus of the electrophotographic type which has a configuration for forming an image on a recording material by transferring a toner image formed on a plurality of image bearing members such as photosensitive drums to the recording material borne and fed by a recording material bearing member. In the image forming apparatus, a charging member which charges an image bearing member, a developing device which supplies a toner as a developer to the image bearing member and forms a toner image, and a transfer member which transfers the toner image from the image bearing member to the recording material are provided for each image bearing member. A transfer belt which constitutes an endless belt is often used as a recording material bearing member. Then, the toner image is transferred from the plurality of image bearing members arranged along a direction of a movement of the recording material by the recording material bearing member onto the recording material, which is electrostatically attracted and fed on the transfer belt. As a transfer member, a transfer roller, etc., which is arranged on an opposite side of the image bearing member across the transfer belt, is used, and the toner image is transferred by applying a transfer voltage to the transfer member.

The image forming apparatus as described above is also provided with a cleaning means to remove a toner which remains on the image bearing member without being transferred to the recording material (transfer residual toner) from the image bearing member. As a cleaning means, following are known. A cleaning roller is provided as a cleaning member which contacts an image bearing member, and the transfer residual toner is attached to the cleaning roller and is temporarily collected during image formation. This prevents the transfer residual toner from affecting a next image forming process and causing image defects. Further, the transfer residual toner temporarily collected on the cleaning roller is discharged from the cleaning roller onto the image bearing member at a predetermined timing during non-image formation. And the transfer residual toner which is discharged onto the image bearing member is then collected in the developing device. The toner collected in the developing device is reused to develop a toner image.

Further, a foreign matter generated from the recording material moves onto the image bearing member when the recording material contacts the image bearing member. The foreign matter is mainly fiber and filler which form paper (so-called "paper dust"), or dust attached to the recording material. When such a foreign matter is attached to the image bearing member, it may affect a subsequent image forming process and cause image defects.

In Japanese Laid-Open Patent Application (JP-A) 2010-165000, a configuration is disclosed in which a foreign matter collecting member is provided to attract and collect a foreign matter from the cleaning roller described above only for the most upstream image bearing member with respect to a direction of movement of the recording material, which is most affected by a foreign matter. In the configuration, a foreign matter, moved to the most upstream image bearing member described above during image formation, is collected by the cleaning roller during non-image formation, and further collected by the foreign matter collecting member and stored in an accommodating portion.

In an image forming apparatus of electrophotographic type, an image bearing member unit provided with an image bearing member may be dismountable from a main assembly of the image forming apparatus and replaceable by a user, a service representative, or other operators. Furthermore, there are some configurations in which a plurality of image bearing member units are integrated and dismountable in order to improve an operability for operators.

However, in a conventional image forming apparatus such as described above, there is a problem that an abrasion amount of the most upstream image bearing member with respect to the direction of the movement of the recording material is larger than that of the image bearing members other than the most upstream image bearing member.

The reason why the abrasion amount of the most upstream image bearing member is large is that the recording material first contacts the most upstream image bearing member while an image is being formed. Most of the foreign matter which is included in the recording material and tends to migrate to the image bearing member is collected by the most upstream image bearing member described above. Furthermore, the foreign matter collected by the most upstream image bearing member described above is interposed between the image bearing member and the cleaning roller or between the image bearing member and a developer carrying member of the developing device, and slides along the image bearing member. This increases the abrasion amount of the most upstream image bearing member described above.

One of factors which determine lifetime of the image bearing member is an occurrence of longitudinal stripe images (stripe images which extend along a direction of movement of the image bearing member surface) caused by a decrease of remaining film thickness of a surface layer of the image bearing member beyond a predetermined value. Thus, when same image bearing members are used as the plurality of image bearing members, only the most upstream image bearing member described above reaches an end of its lifetime earlier than the image bearing members other than the most upstream image bearing member.

Particularly, in a configuration in which the plurality of the image bearing member units, including the most upstream image bearing member unit provided with the most upstream image bearing member described above, are integrated into a single replacement part, the problem becomes more remarkable when the abrasion amount of the most upstream image bearing member is large. This is because, in this case, a lifetime of the entire plurality of integrated image bearing member units is determined by a lifetime of the most upstream image bearing member unit described above.

SUMMARY OF THE INVENTION

Thus, it is an object of the present invention to extend a lifetime of the entire plurality of units which are integrated and replaceable by reducing a difference of a remaining film thickness of a surface layer among each image bearing member in an image forming apparatus in which a plurality of image bearing member units are integrated and replaceable.

The object described above is achieved with the image forming apparatus of the present invention. An image forming apparatus capable of performing an image forming operation in which an image is formed on a recording material includes a first image forming portion including a first image bearing member rotatably movable and including a photosensitive layer, a first charging member configured to charge a surface of the first image bearing member, a first developing device configured to supply a first developer onto the surface of the first image bearing member, a first transferring member configured to transfer the first developer supplied to the surface of the first image bearing member to the recording material, a first cleaning member configured to clean the surface of the first image bearing member in contact with the first image bearing member, and a first collecting member configured to collect a foreign matter deposited on the first cleaning member, and a second image forming portion including a second image bearing member rotatably movable and including a photosensitive layer, a second charging member configured to charge a surface of the second image bearing member, a second developing device configured to supply a second developer onto the surface of the second image bearing member, a second transferring member configured to transfer the second developer supplied to the surface of the second image bearing member to the recording material, and a second cleaning member configured to clean the surface of the second image bearing member in contact with the second image bearing member, and a belt configured to form a first transferring portion in contact with the first image bearing member and to form a second transferring portion in contact with the second image bearing member, the belt nipping and feeding the recording material between itself and the first image bearing member and between itself and the second image bearing member in the first transferring portion and the second transferring portion, respectively, wherein the first image forming portion is disposed upstream of the second image forming portion with respect to a moving direction of the recording material, and a plurality of members including the first image bearing member and the second image bearing member are integrally assembled and are mountable on or dismountable from a main assembly of the image forming apparatus, and wherein a film thickness of the surface of the first image bearing member is larger than a film thickness of the surface of the second image bearing member.

Further features of the present invention will become apparent from the following description of exemplary embodiments (with reference to the attached drawings).

DESCRIPTION OF THE EMBODIMENTS

In the following, an image forming apparatus of the present invention will be described with reference to Figures.

Embodiment 1

<Configuration of Image Forming Apparatus>

Figure 1:
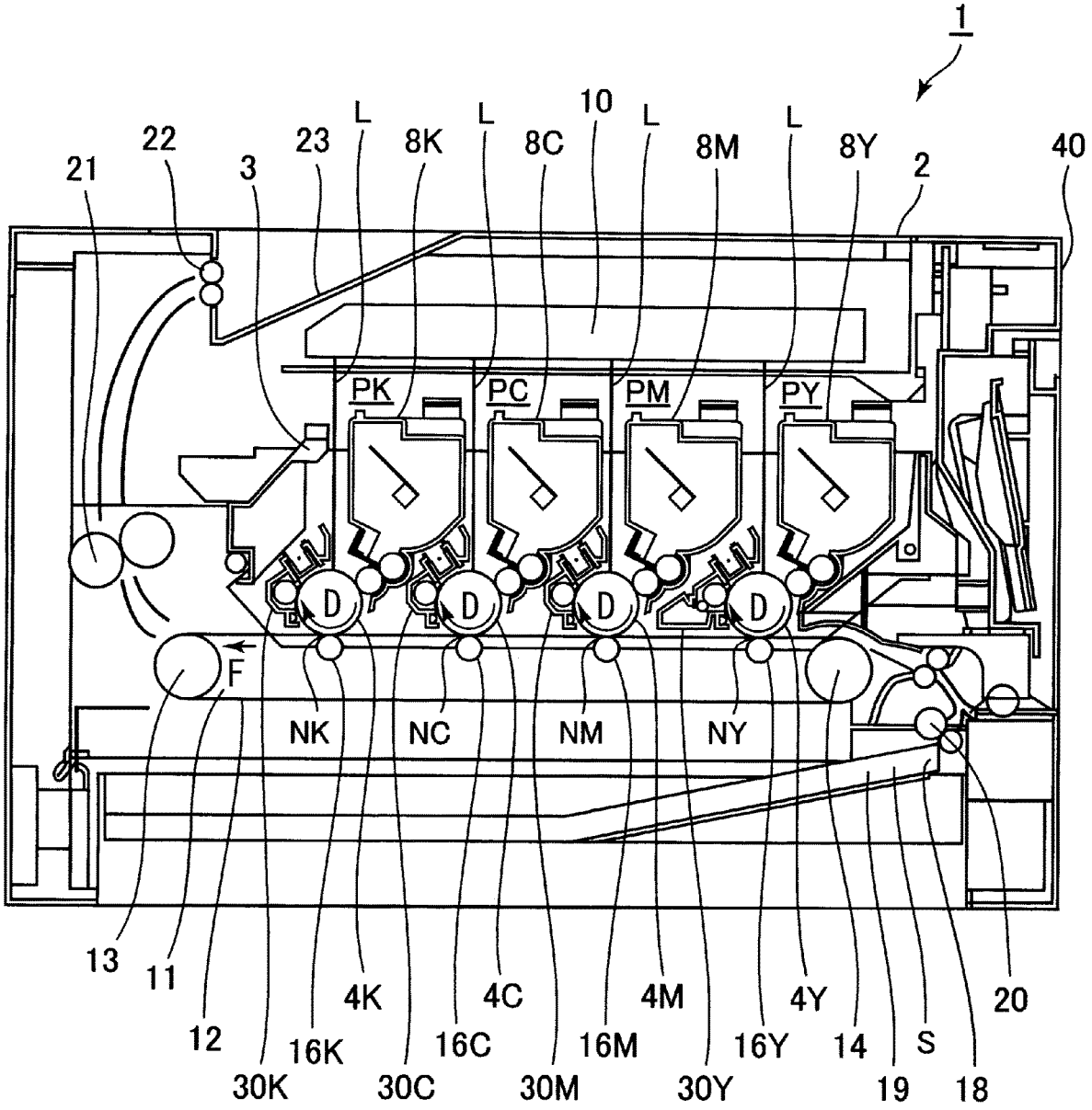
FIG. 1 is a schematic sectional view showing an image forming apparatus.

FIG. 1 is a schematic sectional view showing an image forming apparatus 1 in this embodiment. The image forming apparatus 1 in this embodiment is a color laser printer which applies an electrophotographic image forming process and is able to form a color image on a recording material S according to image information from an external device such as a personal computer.

The image forming apparatus 1 includes four image forming portions (stations) PY, PM, PC, and PK which form images in each color of yellow (Y), magenta (M), cyan (C), and black (K), respectively. An element which includes a same or corresponding function or configuration in the four image forming portions PY, PM, PC, and PK, may be described in a general manner by omitting Y, M, C, and K at an end of a sign indicating which an element is for one of the colors.

In this embodiment, each image forming portion P includes a photosensitive drum 4, which is a drum type (cylindrical) photosensitive body (electrophotographic photosensitive body) as a rotatable image bearing member, a charging device (charging member) 5 as a charging means (FIG. 2), and a developing device 8 as a developing means. Further, each image forming portion P also includes a transfer roller 16, which is a roller type transfer member as a transfer means, a static eliminating light source 31 (FIG. 2) as a static eliminating means, and a cleaning mechanism 36 (FIG. 2) as a cleaning means. The four image forming portions PY, PM, PC, and PK are arranged in a row along a direction of movement of the recording material S (also referred to simply as "a direction of movement of the recording material S") by a transfer belt 12, as will be described later. Further, in this embodiment, an exposure device 10 used as an exposure means in each image forming portion P is constituted as a single unit. Further, in this embodiment, in each image forming portion P, a drum unit 30, which includes the photosensitive drum 4 and the developing device (developer cartridge, developing unit) 8, is a replaceable unit and can be considered a consumable.

Figure 2:
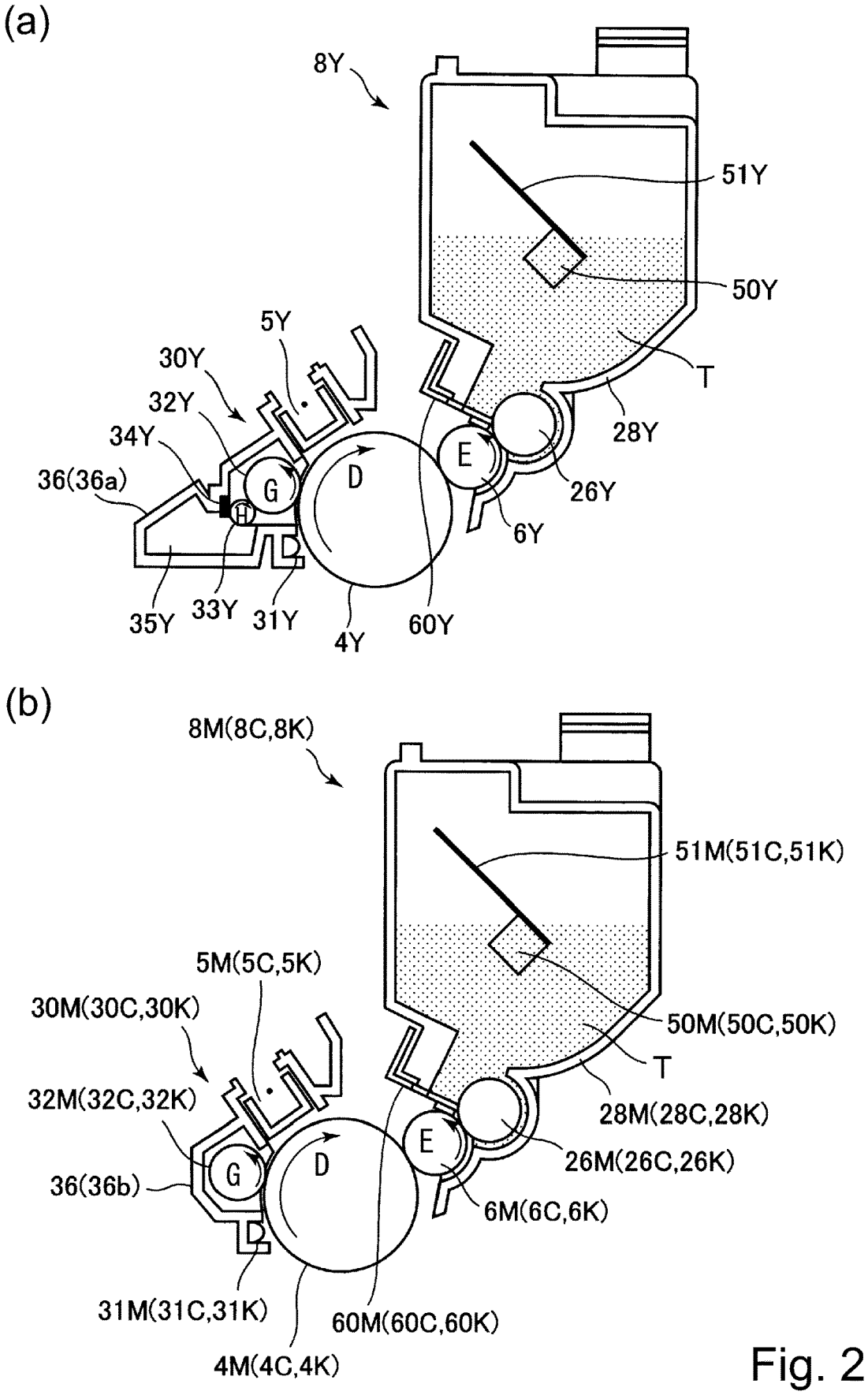
FIG. 2, part (a) and part (b), is a schematic sectional view showing a drum unit and a developer cartridge.

FIG. 2 is a schematic sectional view showing the drum unit 30 and the developer cartridge 8. Part (a) of FIG. 2 shows a drum unit 30Y and a developer cartridge 8Y of the image forming portion PY, which is the most upstream with respect to the direction of the movement of the recording material S. Further, part (b) of FIG. 2 shows drum units 30M, 30C, and 30K of the image forming portions PM, PC, and PK on a downstream side of the most upstream image forming portion PY with respect to the direction of the movement of the recording material S (also referred to simply as "downstream side"), and developer cartridges 8M, 8C, and 8K. That is, part (b) of FIG. 2 shows the drum units 30M, 30C, and 30K of the image forming portions PM, PC, and PK other than the most upstream image forming portion PY with respect to the direction of the movement of the recording material S among the plurality of the image forming portions P, which are provided in the image forming apparatus 1, and the developer cartridges 8M, 8C, and 8K. Incidentally, with respect to the plurality of the image forming portions P or their elements, "upstream" and "downstream" refer to upstream and downstream with respect to the direction of the movement of the recording material S. As shown in FIG. 2, part (a) and (b), in this embodiment, the configuration of the cleaning mechanism is different for the most upstream drum unit 30Y and the drum units 30M, 30C, and 30K on the downstream side. The configuration and the operation of the drum unit 30 and the developer cartridge 8 will be described in detail below.

A cartridge tray 3 is dismountably provided with a main assembly 2 of the image forming apparatus 1. And the drum unit 30 and the developer cartridge 8 are constituted dismountably from the cartridge tray 3, respectively. Further, the main assembly 2 is equipped with the exposure device 10, an electrostatic transfer device 11, a paper feeding unit 18, a fixing device 21, a discharging unit 22, and a front door 40.

The exposure device 10 is provided above the drum units 30 and the developer cartridges 8, which are mounted on the cartridge tray 3, and outputs laser light L according to image information. The exposure device 10 scans and exposes surfaces of the four photosensitive drums 4Y, 4M, 4C, and 4K by the laser beam L.

The electrostatic transfer device 11 is provided below the drum unit 30 and the developer cartridge 8, which are mounted on the cartridge tray 3. The electrostatic transfer device 11 includes a transfer belt 12 constituting an endless belt as a recording material bearing member so as to contact the four photosensitive drums 4Y, 4M, 4C, and 4K. A film-like material is used for the transfer belt 12, such as a resin film or a multilayer film which is provided with resin layers on a rubber base layer. The transfer belt 12 is stretched over a driving roller 13 and a driven roller 14 as a plurality of stretching rollers (supporting rollers) with a predetermined tension. And the transfer belt 12 electrostatically attracts a sheet-like recording material S (recording medium, transfer material, sheet) such as a sheet of paper on an outer peripheral surface of an upper side in FIG. 1, and circulatingly moves so that the recording material S sequentially contacts the four photosensitive drums 4Y, 4M, 4C, and 4K. Four transfer rollers 16Y, 16M, 16C, and 16K are arranged in an inner peripheral surface side of the transfer belt 12, corresponding to each of the four photosensitive drums 4Y, 4M, 4C, and 4K. In this embodiment, the transfer roller 16 is arranged so to oppose to the corresponding photosensitive drum 4 via the transfer belt 12, and contacts the photosensitive drum 4 via the transfer belt 12. Thus, transfer portions NY, NM, NC, and NK, where each of the photosensitive drums 4Y, 4M, 4C, and 4K contact the transfer belt 12, are formed. In this way, the transfer belt 12 contacts each photosensitive drum 4 and forms a transfer portion N, and the recording material S is nipped and fed between the photosensitive drum 4 and the transfer belt 12 in each transfer portion N. During transferring, a predetermined transfer voltage (transfer bias) is applied to each of the transfer rollers 16, and an electric charge is applied to the recording material S via the transfer belt 12. A toner image on the photosensitive drum 4 is transferred to the recording material S, which is contacting the photosensitive drum 4, by an electric field which is generated at this time. In this embodiment, the transfer roller 16 is constituted by coating a sponge layer which is formed of a sponge material as an elastic layer (a foamed rubber material and so on such as a foamed polyurethane) around a roller shaft (core shaft) which is formed of metal and so on.

The paper feeding unit 18 is provided below the electrostatic transfer device 11. The paper feeding unit 18 includes a paper feeding tray 19 as a recording material accommodating portion where the recording material S is stacked and accommodated, a paper feeding roller 20 as a feeding member, etc.

The fixing device 21 and the discharging unit 22 are provided above the electrostatic transfer device 11. The fixing device 21 fixes the toner image, which was transferred onto the recording material S, on the recording material S. Further, the discharging unit 22 discharges the recording material S which has passed through the fixing device 21 to a discharging tray 23.

The cartridge tray 3 includes a dismountable drum unit 30 which is provided with a photosensitive drum 4 corresponding to each of the four developer cartridges 8. In this embodiment, these four drum units 30Y, 30M, 30C, and 30K are integrated with the cartridge tray 3 and form a single replacement part.

Incidentally, in this embodiment, the main assembly 2 corresponds to a portion of the image forming device 1, which excludes the cartridge tray 3, the drum unit 30, and developer cartridge 8.

Figure 3:
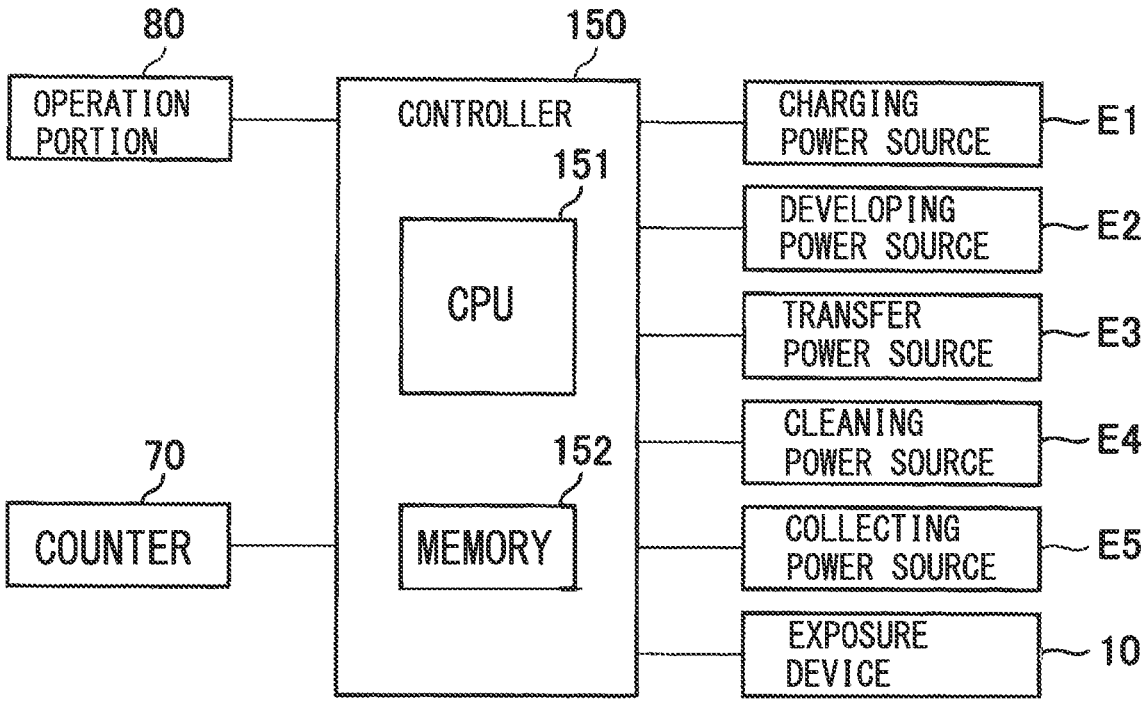
FIG. 3 is a schematic block diagram to illustrate a control mode of an image forming apparatus.

As shown in FIG. 2, parts (a) and (b), the drum unit 30 includes the charging device 5, a static eliminating light source 31, and a cleaning mechanism 36. As shown in part (a) of FIG. 2, the most upstream drum unit 30Y includes a first cleaning mechanism 36*a* as the cleaning mechanism 36. The first cleaning mechanism 36*a* includes a cleaning roller 32 as a cleaning member which cleans a surface of the photosensitive drum 4, and a foreign matter collecting roller 33 as a foreign matter collecting member which collects a foreign matter attached to the cleaning roller 32. Further, the first cleaning mechanism 36*a* includes a scraping member 34 as a foreign matter removing member and a foreign matter collecting container 35 as an accommodating portion. Further, as shown in part (b) of FIG. 2, the drum units 30M, 30C, and 30K on the downstream side include a second cleaning mechanism 36*b* as the cleaning mechanism 36. The second cleaning mechanism 36*b* includes the cleaning roller 32 as the cleaning member. In this embodiment, the second cleaning mechanism 36*b* does not include the foreign matter collecting roller 33, the scraping member 34, and the foreign matter collecting container 35 that the first cleaning mechanism 36*a* includes. Incidentally, in the first cleaning mechanism 36*a* of this embodiment, the cleaning roller 32 is connected to a cleaning power source E4 (FIG. 3), and the foreign matter collecting roller 33 is connected to a collecting power source E5 (FIG. 3). In the second cleaning mechanism 36*b*, the cleaning roller 32 is connected to the cleaning power source E4 (FIG. 3).

As shown in FIG. 2, parts (a) and (b), the developer cartridge 8 includes a developer frame (developer container) 28, which accommodates a toner T as a developer, and a developing roller 6 as a developer carrying member which carries toner T on its surface and is rotatable. Further, the developer cartridge 8 includes a supplying roller 26 as a developer supplying member which supplies the toner T to the developing roller 6 and a regulating blade 60 as a developer regulating member which contacts the surface of the developing roller 6 and regulates a layer thickness of the toner T carried on the surface of the developing roller 6. Further, the developer cartridge 8 includes a rotatable mixing shaft 50 and a mixing sheet 51 which is fixed to the mixing shaft 50, as a mixing and feeding member for mixing and feeding the toner T in the developer frame 28. In this embodiment, the toner T is a non-magnetic single-component developer.

<Image Forming Process>

Next, referring to FIG. 1 and FIG. 2, the image forming process in the image forming apparatus 1 of this embodiment will be described.

During an execution of the image forming process, the photosensitive drum 4 is rotationally driven in a direction of an arrow D (clockwise direction) in FIG. 1 and FIG. 2 at a predetermined peripheral speed by a driving motor (not shown) as a driving means. Further, the transfer belt 12 of the electrostatic transfer device 11 is rotated (circulatingly moved) in a direction of an arrow F (counterclockwise direction) in FIG. 1 at a peripheral speed according to a peripheral speed of the photosensitive drum 4 by the driving roller 13 which is rotationally driven by a driving motor (not shown) as a driving means. The surface of the rotating photosensitive drum 4 is uniformly charged at a predetermined potential of a predetermined polarity (positive polarity in this embodiment) by the charging device 5. During a charging process, a predetermined charging voltage (charging bias) is applied to the charging device 5 by a charging voltage power source E1 (FIG. 3) as a charging voltage application portion. In this embodiment, the charging power source E1 applies a DC voltage of positive polarity as a charging voltage to the charging device 5. The charged surface of the photosensitive drum 4 is scanned and exposed by the exposure device 10 with a laser beam L output according to an image signal of each color, and an electrostatic latent image (electrostatic image) is formed on the photosensitive drum 4 according to the image signal of each color. In this embodiment, a laser light L is emitted to an image portion (printing portion, image area) on the photosensitive drum 4, where a potential (non-image portion potential, dark portion potential) of a non-image portion (non-printing portion, non-image area) has been formed by being uniformly charged. As a result, an absolute value of a potential at a point where the laser light L is emitted decreases, and a potential of the image portion (image portion potential, bright portion potential) is formed.

The electrostatic latent image formed on the photosensitive drum 4 is developed (visualized) by a toner supplied by the developer cartridge 8 and forms a toner image (developer image) on the photosensitive drum 4 according to an image signal of each color. The toner T in the developer frame 28 is fed to the supplying roller 26 while circulating in the developer frame 28 by the mixing sheet 51 which is fixed to the mixing shaft 50. The supplying roller 26 supplies the toner T to the developing roller 6. The developing roller 6 is constituted of a rubber layer which is formed of rubber material as an elastic layer coated around a roller shaft (core shaft) formed of metal, etc. For example, a solid rubber member or sponge member, which has elasticity, is used for the rubber layer. In this embodiment, the developing roller 6 contacts the photosensitive drum 4. The supplying roller 26 is constituted of a sponge layer formed of a sponge material (foamed rubber material, etc. such as foamed polyurethane) as an elastic layer, coated around a roller shaft (core shaft) formed of metal, etc. In this embodiment, the supplying roller 26 contacts the developing roller 6. The developing roller 6 is rotationally driven in a direction of an arrow E (counterclockwise direction) in FIG. 2 at a predetermined peripheral speed. That is, the developing roller 6 rotates so that the photosensitive drum 4 and the developing roller 6 move in a forward direction at a contact portion between the photosensitive drum 4 and the developing roller 6. In this embodiment, the developing roller 6 is rotatably driven by driving power from a driving motor (not shown) which drives the photosensitive drum 4, which is branched and transmitted to it. Incidentally, a driving means for rotating the photosensitive drum 4 and a driving means for rotating the developing roller 6 may be provided separately. The developing roller 6 may be rotationally driven with a difference of a peripheral speed (for example, the developing roller 6 is faster) relative to the photosensitive drum 4, or it may be rotationally driven at a same peripheral speed as the photosensitive drum 4. The toner T which is supplied to the developing roller 6 enters between the developing roller 6 and the regulating blade 60 and is carried on the developing roller 6 as a thin layer of a certain thickness. The toner T is charged to a predetermined polarity (positive polarity in this embodiment) by frictional charging between the regulating blade 60 and the developing roller 6, and between the supplying roller 26 and the developing roller 6. That is, in this embodiment, a normal charging polarity ("normal polarity") of the toner T, which is a charging polarity of the toner T during a development, is positive polarity. The regulating blade 60 is constituted of a metal plate made of stainless steel, etc., which is laminated with a resin member. It is possible to control a pressure and a frictional charge applied to the toner T which has entered between the developing roller 6 and the regulating blade 60 by the shape and material of the resin member. Silicone rubber or urethane rubber is used as the resin member.

The toner T, which is carried on the developing roller 6 and charged with positive polarity, is supplied to an electrostatic latent image which is formed on the photosensitive drum 4 by directly contacting the developing roller 6 with the photosensitive drum 4. By this, the toner T is attached to the image portion of the electrostatic latent image, and a toner image is formed on the photosensitive drum 4. Further, during a development, a predetermined developing voltage (developing bias) is applied to the developing roller 6 by a developing power source E2 (FIG. 3) as a developing voltage applying portion. In this embodiment, the developing power source E2 applies a DC voltage of positive polarity as a developing voltage to the developing roller 6. The developing voltage is set to a potential between a potential of an image area portion and a potential of a non-image portion on the photosensitive drum 4. That is, a potential of an electrostatic latent image which is formed on the photosensitive drum 4 is greater in absolute value than a voltage applied to the developing roller 6 in the non-image portion where the toner T does not attach (no image is formed). On the other hand, a potential of the electrostatic latent image which is formed on the photosensitive drum 4 is smaller in absolute value than a voltage applied to the developing roller 6 in the image portion where the toner T attaches (an image is formed). By this setting, the toner T, which is charged with positive polarity, moves from the developing roller 6 to the image portion of the electrostatic latent image which is formed on the photosensitive drum 4. In this way, in this embodiment, the toner T, which is charged with a same polarity as a charging polarity of the photosensitive drum 4 (positive polarity in this embodiment), is attached to an exposed portion (image portion) on the photosensitive drum 4 where an absolute value of a potential is reduced by being exposed after being uniformly charged.

Here, in this embodiment, a peripheral speed of the photosensitive drum 4 is 100 mm/sec, which is common to all four. Further, in this embodiment, a peripheral speed of the developing roller 6 is 150 mm/sec, which is common to all four. In this embodiment, the peripheral speed of each developing roller 6 is faster than the peripheral speed of each photosensitive drum 4. In this embodiment, in this way, the peripheral speed of the developing roller 6 is set faster than that of the photosensitive drum 4, and an amount of the toner T which moves from the developing roller 6 to the photosensitive drum 4 is adjusted, then an appropriate image density is maintained.

Further, at a predetermined control timing, the paper feeding unit 18 separates and feeds each sheet of the recording material S. The recording material S is fed to the transfer belt 12 at a predetermined control timing so that a timing when a leading end of a toner image on the most upstream photosensitive drum 4Y moves to a transfer portion NY and a timing when the recording material S is fed to the transfer portion NY are synchronized (starting positions of image forming are matched). A toner image is transferred from each photosensitive drum 4 in sequence to the recording material S, which is electrostatically attracted to the transfer belt 12, by an electric field which is formed between each photosensitive drum 4 and each transfer roller 16. During transferring, a predetermined transfer voltage (transfer bias) is applied to each transfer roller 16 by a transfer power source E3 (FIG. 3) as a transfer voltage applying portion. In this embodiment, the transfer power source E3 applies a DC voltage of negative polarity, which is opposite to a normal polarity of the toner T (positive polarity in this embodiment), to the transfer roller 16 as a transfer voltage. Thus, it is possible to electrically attract the toner T, which is positively charged, to a side of the recording material S.

The recording material S, to which four color toner image has been transferred, is separated from the transfer belt 12 and fed to the fixing device 21. The fixing device 21 heats and presses the recording material S, which bears an unfixed toner image, and fixes (melt, fix) the toner image to the recording material S. After that, the recording material S is discharged (output) by the discharging unit 22 to the discharging tray 23 which is provided outside of the main assembly 2.

On the other hand, after transferring the toner T onto the recording material S, static eliminating light is emitted onto a surface of the photosensitive drum 4 by the static eliminating light source 31 and a surface potential of the photosensitive drum 4 is reduced to around 0 V. In this way, the surface potential of the photosensitive drum 4 is stabilized, and a cleaning performance of the cleaning roller 32 of toner remaining on the photosensitive drum 4 without being transferred to the recording material S (transfer residual toner) and foreign matter moved from the recording material S to the photosensitive drum 4 is improved. Incidentally, an effect of the cleaning roller 32 will be described in detail below. Further, by stabilizing the surface potential of the photosensitive drum 4, it is possible to charge the surface of the photosensitive drum 4 more uniformly by the charging device 5. Incidentally, a meaning of a static elimination includes a removal (attenuation) of at least a part of electric charge.

<Control Mode>

FIG. 3 is a schematic block diagram showing a control mode of a main part of the image forming apparatus 1 in this embodiment. The image forming apparatus 1 is provided with a control portion (controller) 150. The control portion 150 includes a CPU 151 as an arithmetic control means which is a central element performing an arithmetic processing, and a memory (storage element) 152 such as ROM and RAM as a storage means, and an input/output portion (not shown) which controls to send and receive signals among various elements which are connected to the control portion 150. The RAM stores a result of a sensor detection, a result of calculation, etc., and the ROM stores a control program, a pre-determined data table, etc.

The control portion 150 is a control means which comprehensively controls an operation of the image forming apparatus 1. The control portion 150 executes a predetermined image forming sequence by controlling to send and receive various electrical information signals and controlling a timing of driving, etc. The control portion 150 is connected to each part of the image forming apparatus 1. For example, in relation to this embodiment, the control portion 150 is connected to the charging power source E1, the developing power source E2, the transfer power source E3, the cleaning power source E4, the collecting power source E5, the exposure device 10, etc. The control portion 150 controls ON/OFF and output values of these various power sources E1, E2, E3, E4, and E5, an amount of exposure by the exposure device 10, etc., and controls an operation of an image forming and an operation of the cleaning mechanism 36 described below.

Incidentally, in this embodiment, the charging power source E1, the developing power source E2, the transfer power source E3, and the cleaning power source E4 are provided independently with each image forming portion P. However, at least one of the charging power source E1, the developing power source E2, the transfer power source E3, and the cleaning power source E4 may be shared by some of image forming portions P (or all of image forming portions P). Further, in this embodiment, the collecting power source E5 is provided only with the most upstream image forming portion PY.

The image forming apparatus 1 is capable of executing a job (print operation), which is a series of operations to form images on a single recording material S or a plurality of recording materials S by a single start instruction from an external device (not shown) such as a personal computer in this embodiment. The job generally includes an image forming step (printing step), a pre-rotation step, a sheet interval step in a case of forming image on a plurality of recording materials S, and a post-rotation step. The image forming step is a period when an electrostatic image is actually formed on the photosensitive drum 4, the electrostatic image is developed (toner image forming), the toner image is transferred, and the toner image is fixed, and "during image formation" refers to this period. In more detail, a timing during image formation differs at positions where the electrostatic image forming, the toner image forming, the toner image transfer, and the toner image fixing are performed. The pre-rotation step is a period when a preparatory operation is performed before the image forming step. The sheet interval step is a period corresponding to an interval time between recording materials S when an image forming step is continuously performed on a plurality of recording materials S (during a continuous image formation). The post-rotation step is a period when an organizing operation (preparation operation) is performed after the image forming step. "During non-image formation" is a period other than "during image formation", and includes the pre-rotation step, the sheet interval step, the post-rotation rotation step, described above, and also a pre-multiple rotation step, which is a preparatory operation at a time of power on or recovery from a sleep mode of the image forming apparatus 1. In this embodiment, at a predetermined timing during non-image formation, operations such as discharging the transfer residual toner, which is attached to the cleaning roller 32, from the cleaning roller 32 to the photosensitive drum 4, are performed as will be described below.

<Cleaning Mechanism>

Figure 4:
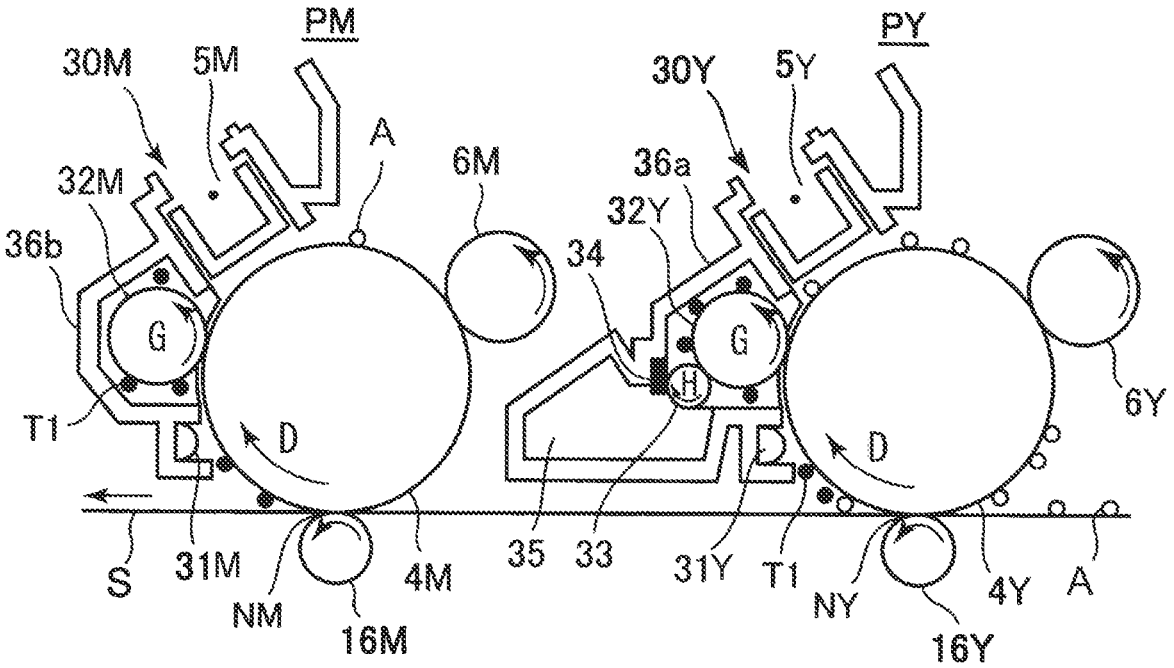
FIG. 4, part (a) and part (b), is a schematic diagram to illustrate a collection of a transfer residual toner and a foreign matter.
Figure 4:
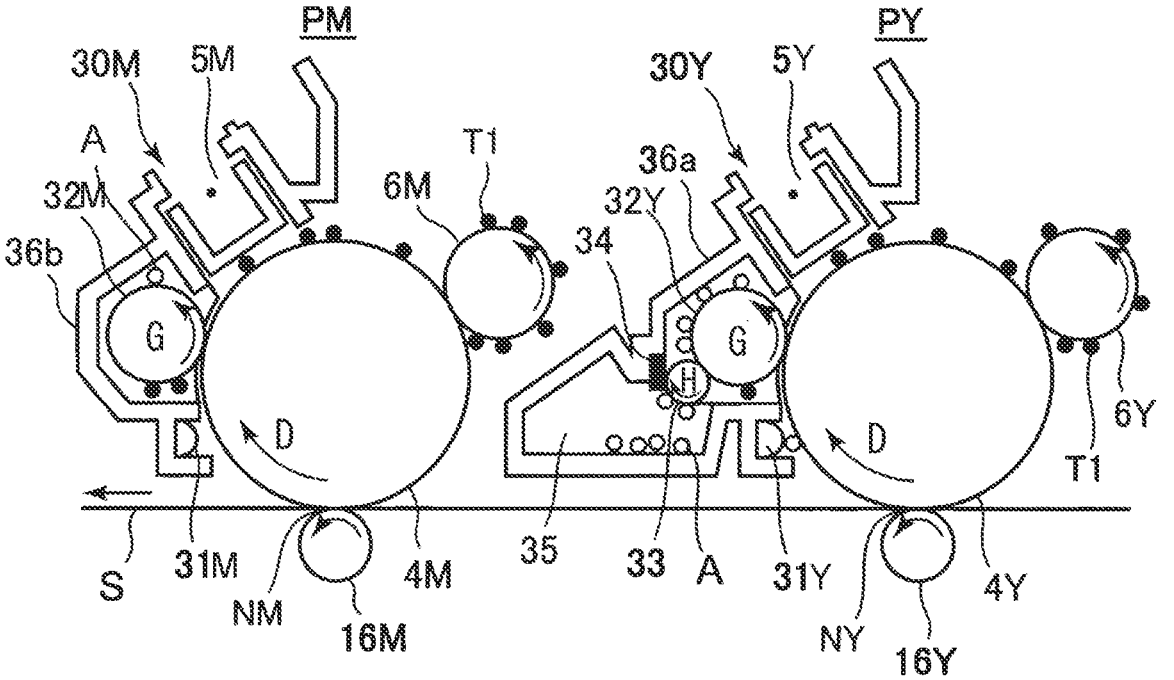

Next, the cleaning mechanism 36 in this embodiment will be described in more detail. FIG. 4 is a schematic diagram to illustrate an action of the cleaning mechanism 36 in this embodiment. Part (a) of FIG. 4 shows an area around the photosensitive drum 4Y of the most upstream image forming portion PY and an area around the photosensitive drum 4M of the image forming portion PM for M which is arranged adjacent to the photosensitive drum portion PY on its downstream side, while the toner T is being transferred to the recording material S (during the image forming time). Part (b) of FIG. 4 shows an area around the photosensitive drum 4Y of the most upstream image forming portion PY, and an area around the photosensitive drum 4M of the image forming portion PM for M which is arranged adjacent to the photosensitive drum portion PY on its downstream side, while the toner T is not being transferred to the recording material S (during non-image formation). Here, with respect to the image forming portions PM, PC, and PK on the downstream side, the image forming portion PM for M is mainly described, and in this embodiment a configuration and an operation of image forming portions PM, PC, and PK on the downstream side are substantially same except that colors of toner used for development are different. Incidentally, in FIG. 4, for simplicity, Y and M at an end of a reference numeral indicating that an element is for one of the colors, are appropriately omitted. As described above, the first cleaning mechanism 36*a* is provided as the cleaning mechanism 36 in the most upstream image forming portion PY. Further, the second cleaning mechanism 36*b* is provided as the cleaning mechanism 36 in the image forming portion PM on the downstream side.

Temporary Collection of Transfer Residual Toner

With reference to part (a) of FIG. 4, an operation of the cleaning mechanism 36 while a toner image is being transferred to the recording material S (during image formation) will be described.

First, a behavior of a transfer residual toner T1 will be described. In the image forming portions PY and PM of the most upstream side and the downstream side, respectively, the cleaning roller 32 contacts the photosensitive drum 4 and rotates in a direction of an arrow G (counterclockwise direction) in the figure. That is, the cleaning roller 32 rotates so that the photosensitive drum 4 and the cleaning roller 32 move in a forward direction at a contact portion between the photosensitive drum 4 and the cleaning roller 32. In this embodiment, the cleaning roller 32 is rotationally driven by driving power from a driving motor (not shown), which drives the photosensitive drum 4, which is branched and transmitted to it. Incidentally, a driving means for rotating the photosensitive drum 4 and a driving means for rotating the cleaning roller 32 may be provided separately. The cleaning roller 32 may be rotationally driven with a difference of a peripheral speed (for example, the cleaning roller 32 is faster) relative to the photosensitive drum 4, or it may be rotationally driven at a same peripheral speed as the photosensitive drum 4. Further, in this embodiment, the cleaning roller 32 is constituted of a rubber layer which is formed of rubber material as an elastic layer coated around a roller shaft (core shaft) formed of metal, etc. For example, a solid rubber member or a sponge member, which has elasticity, is used for the rubber layer. On a surface of the photosensitive drum 4 which contacts the cleaning roller 32, a surface potential is reduced to around 0 V by the static eliminating light source 31. Further, a predetermined cleaning voltage (cleaning bias) is applied to the cleaning roller 32 by the cleaning power source E4. In this embodiment, the cleaning power source E4 applies a DC voltage of negative polarity, which is opposite to the normal polarity of the toner T, to the cleaning roller 32 as a cleaning voltage. Thus, the transfer residual toner T1, which is positively charged, moves along an electric field from the photosensitive drum 4 to the cleaning roller 32 and is collected by the cleaning roller 32. Incidentally, the cleaning voltage should be a higher voltage of an opposite polarity to the normal polarity of the toner (negative polarity in this embodiment) than the surface potential of the photosensitive drum 4 at a contact portion between the cleaning roller 32 and the photosensitive drum 4.

In the most upstream image forming portion PY, the foreign matter collecting roller 33 contacts the cleaning roller 32 and rotates in an arrow H direction (clockwise direction) in the figure. That is, the foreign matter collecting roller 33 rotates so that the cleaning roller 32 and the foreign matter collecting roller 33 move in a forward direction at a contact portion between the cleaning roller 32 and the foreign matter collecting roller 33. In this embodiment, the foreign matter collecting member 33 is rotationally driven by a driving power from a driving motor (not shown) which drives the photosensitive drum 4, which is branched and transmitted to it. The foreign matter collecting member 33 may be rotationally driven with a difference of a peripheral speed (for example, the foreign matter collecting member 33 is faster) relative to the cleaning roller 32, or it may be rotationally driven at a same peripheral speed as the cleaning roller 32. Further, the foreign matter collecting roller 33 may be rotated by the cleaning roller 32. Further, the foreign matter collecting roller 33 is constituted of a metal roller. Incidentally, the foreign matter collecting roller 33 may be constituted of a roller with an elastic layer similar to that of the cleaning roller 32. A predetermined voltage during a toner collection (bias at a toner collecting time) is applied to the foreign matter collecting roller 33 by the collecting power source E5. In this embodiment, the collecting power source E5 applies a DC voltage of a positive polarity, which is a same polarity as the normal polarity of the toner T, to the foreign matter collecting roller 33 as a voltage during a toner collection. Thus, the positive polarity transfer residual toner T1 which is collected to the cleaning roller 32 does not move to the foreign matter collecting roller 33, but is held on the cleaning roller 32. Incidentally, the voltage during a toner collection should be a higher voltage in a normal polarity side of the toner (positive polarity side in this embodiment) than a potential of the cleaning roller 32 at the contact portion between the foreign matter collecting roller 33 and the cleaning roller 32.

Next, a behavior of a foreign matter A, such as paper fiber and filler (generally known as "paper dust") or dust, which is generated from the recording material S, will be described. An amount of the foreign matter A which moves to the photosensitive drum 4Y of the most upstream image forming portion PY is large, and an amount of that which moves to the photosensitive drum 4M of the image forming portion PM on the downstream side is small. This is because most of the foreign matter A, which is generated from the recording material S, is removed in the transfer portion NY of the most upstream image forming portion PY. Thus, in this embodiment, the foreign matter collecting roller 33, the scraping member 34, and the foreign matter collecting container 35, which are used to separate and collect the foreign matter A, are provided only in a first cleaning mechanism 36*a* of the most upstream image forming portion PY. And these members are not provided with a second cleaning mechanism 36*b* of the image forming portion PM on the downstream side. This reduces an overall size of the apparatus.

In the most upstream image forming portion PY, a transfer voltage of negative polarity, for example, around −1,000V, is applied to the transfer roller 16Y during transferring. Incidentally, this transfer voltage should be a higher voltage in an opposite polarity side (negative polarity side in this embodiment) to the normal polarity of the toner than a surface potential of an image portion on the photosensitive drum 4Y in the transfer portion NY. As a result, the positively charged toner T on the photosensitive drum 4Y is attracted to the recording material S and is transferred onto the recording material S. In this process, the foreign matter A on the recording material S or inside the recording material S is negatively charged by a negative polarity discharge or an injection charge of the transfer voltage. Then, the foreign matter A moves onto the photosensitive drum 4Y along an electric field caused by the transfer voltage. During transferring, a cleaning voltage, with a negative polarity side relative to a surface potential of the photosensitive drum 4Y at the contact portion between the cleaning roller 32 and the photosensitive drum 4Y, is applied to the cleaning roller 32 which contacts the photosensitive drum 4Y. Thus, the foreign matter A, which is charged with a negative polarity, is not collected by the cleaning roller 32.

In the most upstream image forming portion PY, after transferring, the photosensitive drum 4Y is uniformly charged to a positive polarity by a charging device 5Y. Further, a developing voltage of a negative polarity side, relative to a surface potential (a potential of a non-image portion) of the photosensitive drum 4Y at the contact portion between the developing roller 6Y and the photosensitive drum 4Y, is applied to the developing roller 6Y. Thus, the foreign matter A, which is charged with a negative polarity, is not collected by the developing roller 6Y. Further, the transfer voltage of a negative polarity is also applied to the transfer roller 16Y. Thus, the foreign matter A, which is charged with a negative polarity, does not move to the recording material S or the transfer belt 12.

Therefore, in a setting of a voltage applied to each roller during transferring described above, the transfer residual toner T1 is collected and held by the cleaning roller 32 in each image forming portion P, and the foreign matter A is carried by the photosensitive drum 4Y in the most upstream image portion PY.

Incidentally, in the embodiment, settings of transfer voltage, developing voltage, and collecting voltage during image formation are the same in all image forming portions P.

Collection of Transfer Residual Toner and Collection of Foreign Matter

With reference to part (b) of FIG. 4, an operation of the cleaning mechanism 36 other than during transferring (during non-image formation) will be described.

In the image forming portions PY and PM of the most upstream side and the downstream side, respectively, at a predetermined timing other than during transferring, a predetermined discharging voltage (discharging bias) is applied to the cleaning roller 32 by the cleaning power source E4. In the embodiment, the cleaning power source E4 applies a DC voltage of positive polarity, which is the same polarity as the normal polarity of the toner T, to the cleaning roller 32 as a discharging voltage. Incidentally, the discharging voltage should be a higher voltage of a normal polarity of the toner (positive polarity in this embodiment) than a surface potential of the photosensitive drum 4 at the contact portion between the cleaning roller 32 and the photosensitive drum 4. Further, at this time, a predetermined voltage during foreign matter collection (bias during foreign matter collection) is applied to the foreign matter collecting roller 33 in the most upstream image forming portion PY by the collecting power source E5. In the embodiment, the collecting power source E5 applies a DC voltage of positive polarity, which is larger in absolute value than a discharging voltage which is applied to the cleaning roller 32, to the foreign matter collecting roller 33 as a voltage during foreign matter collection. Incidentally, the voltage during foreign matter collection should be a higher voltage of a normal polarity of the toner (positive polarity in the embodiment) than a potential of the cleaning roller 32 at the contact portion between the foreign matter collecting roller 33 and the cleaning roller 32.

Under the potential settings described above, in the image forming portions PY and PM of the most upstream side and the downstream side, respectively, the positively charged transfer residual toner T1 is discharged from the cleaning roller 32 onto the photosensitive drum 4. At this time, a developing voltage of a negative polarity of a surface potential of the photosensitive drum 4 (non-image portion potential) at the contact portion between the developing roller 6 and the photosensitive drum 4 is applied to the developing roller 6. Thus, the transfer residual toner T1, which is discharged onto the photosensitive drum 4, is collected by the developing roller 6 and then reused as the toner T during image formation (during development). Further, under the potential settings described above, the foreign matter A on the photosensitive drum 4Y, which is charged with a negative polarity in the most upstream image forming portion PY, is collected by the cleaning roller 32 and then collected by the foreign matter collecting roller 33. The foreign matter collecting roller 33 is urged with the scraping member 34, and the scraping member 34 slides on a surface of the foreign matter collecting roller 33 according to a rotation of the foreign matter collecting roller 33. Elastic members such as sponge and felt are used as the scraping member 34. The scraping member 34 may be a rubber blade or a plastic film with elasticity. The foreign matter A, which is collected by the foreign matter collecting roller 33, is removed from the foreign matter collecting roller 33 by the scraping member 34 and is dropped into and collected in the foreign matter collecting container 35.

Incidentally, in the embodiment, the settings of the transfer voltage and the developing voltage are the same for all the image forming portions P, both during image formation and when collecting the transfer residual toner T1 in the developing cartridge 8 during non-image formation. Further, in the embodiment, settings of discharging voltages are the same for all the image forming portions P.

Further, discharging of the transfer residual toner T1 from the cleaning roller 32 and collecting the transfer residual toner T1 by the developing cartridge 8 may be executed at any timing such as during a sheet interval step, and is not limited to a post-rotation step, as long as it is during non-image formation.

Further, most of the foreign matter A, which is generated from the recording material S, is removed at the transfer portion NY of the most upstream image forming portion PY.

In the embodiment, the second cleaning mechanism 36*b* of the image forming portion PM in the downstream side is not provided with a foreign matter collecting roller 33 to collect the foreign matter A. When the foreign matter A in a small amount moves to the photosensitive drum 4M of the image forming portion PM in the downstream side, the foreign matter A is sometimes held on the photosensitive drum 4 and the cleaning roller 32 (FIG. 4, parts (a) and (b)).

<Reduction of Difference in Remaining Film Thickness>

As described above, an amount of the foreign matter A generated from the recording material S, which moves to the photosensitive drum 4, is significantly higher in the most upstream image forming portion PY, and lower in the image forming portions PM, PC, and PK in the downstream side. In particular, as in the embodiment, in a constitution where the recording material S contacts the photosensitive drum 4 directly, an amount of the foreign matter A generated from the recording material S, which moves to the photosensitive drum 4, increases. The greater an amount of the foreign matter A moving to the photosensitive drum 4, the greater an amount of the foreign matter A interposed between the photosensitive drum 4 and the cleaning roller 32, and between the photosensitive drum 4 and the developing roller 6, and then an abrasion amount of the photosensitive drum 4 caused by being slid with the photosensitive drum 4 by the foreign matter A, increases. That is, an abrasion amount of the photosensitive drum 4Y of the most upstream image forming portion PY is greater than that of the photosensitive drum 4M, 4C, and 4K of the image forming portions PM, PC, and PK respectively in the downstream side. As a result, the photosensitive drum 4Y of the most upstream image forming portion PY reaches an end of lifetime earlier than the photosensitive drums 4M, 4C, and 4K of the image forming portions PM, PC, and PK respectively. That is, the most upstream drum unit 30Y reaches an end of lifetime earlier than the drum units 30M, 30C, and 30K in the downstream side. In particular, as in the embodiment, in a constitution where the four drum units 30 are integrated into a single replacement part, when the most upstream drum unit 30Y reaches an end of lifetime first, a whole of the four drum units 30 also reach the end of lifetime.

Therefore, in the embodiment, a film thickness (initial condition, brand-new condition) of a surface layer of the photosensitive drum 4Y of the most upstream image forming portion PY is made thicker than film thicknesses (initial condition, brand-new condition) of surface layers of the photosensitive drums 4M, 4C, and 4K of the image forming portions PM, PC, and PK respectively in the downstream side. Consequently, a time when the most upstream photosensitive drum 4Y reaches an end of its lifetime and a time when the photosensitive drums 4M, 4C, and 4K in the downstream side reach ends of their lifetimes become closer, and each drum unit 30 reaches an end of its lifetime at an almost same time. As a result, it is possible to extend an overall lifetime of the four drum units 30, which are integrated into a single replacement part.

Figure 5:
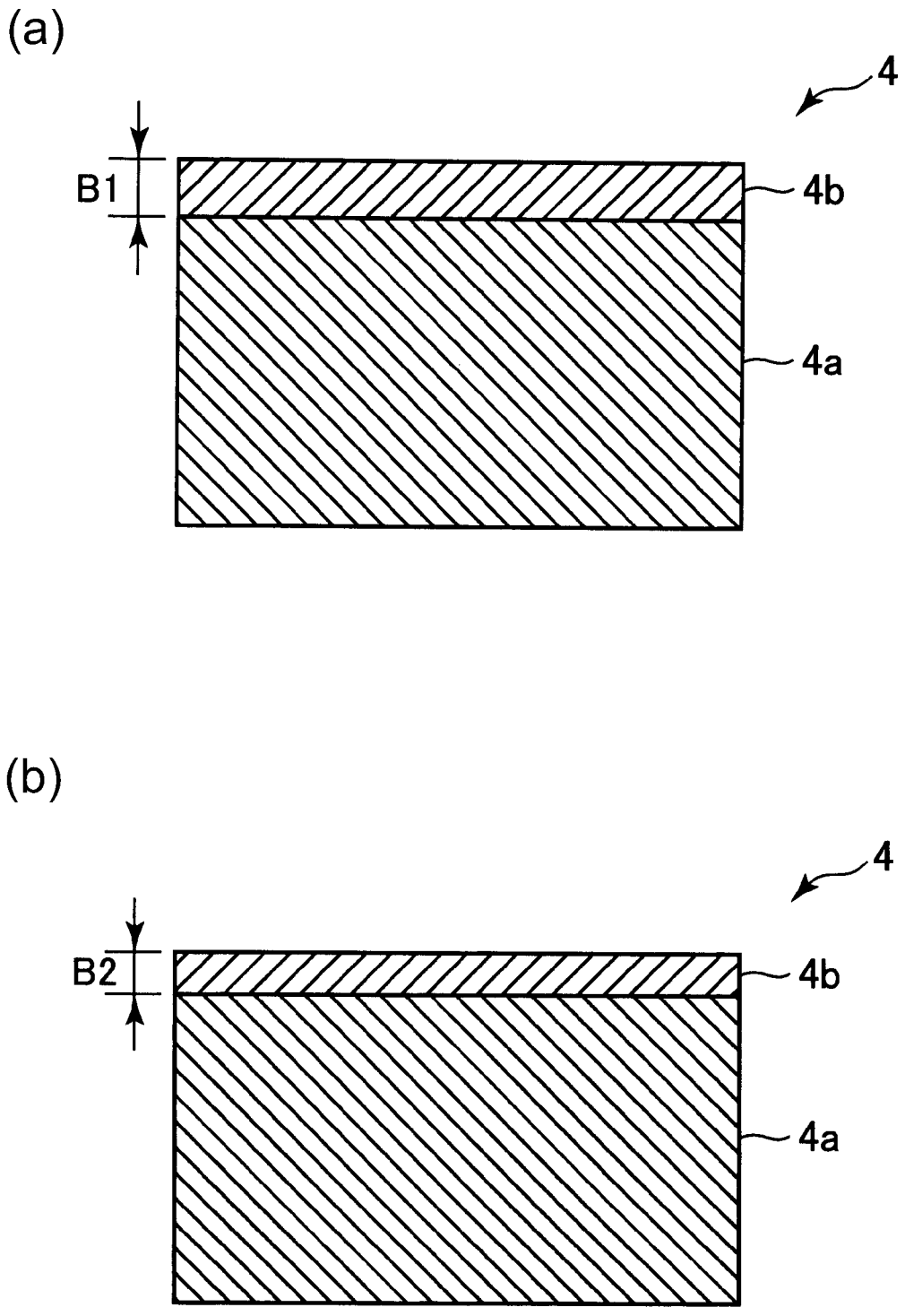
FIG. 5, part (a) and part (b), is a schematic diagram showing one of examples of a layer structure of a photosensitive drum.

In the embodiment, a single layer type photosensitive member, which is an organic photosensitive member whose charging polarity is a positive polarity, is used for the photosensitive drums 4Y, 4M, 4C, and 4K in the image forming portions PY, PM, PC, and PK of the most upstream and the downstream side. That is, as shown schematically in section in FIG. 5, parts (a) and (b), in the embodiment, each photosensitive drum 4 is constituted of a cylindrical base body 4*a* which is formed of a conductive material such as metal, surrounded by a surface layer 4*b* of a single layer, which is a photosensitive layer mainly made of resin. Further, in the embodiment, a same material as the surface layer 4*b* is used for the photosensitive drums 4Y, 4M, 4C, and 4K of the image forming portions PY, PM, PC, and PK respectively in the most upstream and the downstream side. Incidentally, in the embodiment, polycarbonate resin is used as a binder resin material for the surface layer. And in the embodiment, a film thickness (initial condition) B1 of the surface layer 4*b* of the photosensitive drum 4Y in the most upstream image forming portion PY, is greater than a film thickness (initial condition) B2 of the surface layers 4*b* of the photosensitive drums 4M, 4C, and 4K of the image forming portions PM, PC, and PK respectively in the downstream side.

In the embodiment, the film thickness (initial condition) of the surface layer of the photosensitive drum 4Y in the most upstream image forming portion PY is 26 μm, and the film thickness (initial condition) of the surface layers in the photosensitive drums 4M, 4C, and 4K of the image forming portions PM, PC, and PK respectively in the downstream side is 24 μm. Incidentally, the film thickness of the surface layer of the photosensitive drum 4 is not limited to the values in the embodiment, and may be adjusted as appropriate.

Incidentally, a photosensitive drum generally includes a conductive supporting member (substrate) and a photosensitive layer formed on the supporting member. The photosensitive layer may be a single layer type of a photosensitive layer which contains a charge transporting substance and a charge generating substance in a same layer, or it may be a lamination type of a photosensitive layer which is formed by laminating a charge generation layer which contains a charge generating substance and a charge transport layer which contains a charge transporting substance. Further, a protective layer may also be provided on the photosensitive layer. The surface layer of the photosensitive drum is a layer arranged in an outermost surface side of the photosensitive drum. That is, the surface layer of the photosensitive drum is a layer which is most separated from the supporting member and includes a surface which bears a toner.

A definition of reaching an end of a lifetime of the photosensitive drum 4 in the embodiment will be described. The surface layer of the photosensitive drum 4 is slid with the cleaning roller 32, the developing roller 6, and the transfer belt 12 due to repeated image forming operations of the image forming apparatus 1 and then gradually abraded. As the surface layer of the photosensitive drum 4 is abraded, many longitudinal stripe images (stripe images which extend along a moving direction of the surface of the photosensitive drum 4) occur on halftone images due to uneven charging potential caused by uneven abrasion. In the embodiment, a timing when a longitudinal stripe image is occurred is defined as an end of a lifetime of the photosensitive drum 4.

Further, a method of a notification of reaching an end of a lifetime of the photosensitive drum 4 (drum unit 30) in the embodiment will be described. In the embodiment, as shown in FIG. 3, the control portion 150 calculates a total driving time for rotationally driving the photosensitive drum 4 and stores it in a counter 70 which is a storing portion. And, when the total driving time reaches a predetermined threshold value, the control portion 150 controls to notify an operator such as a user by displaying information indicating that the photosensitive drum 4 has reached an end of its lifetime on an operation portion (operation panel) 80 which is provided with the image forming apparatus 1. The predetermined threshold value described above is preset and stored in the memory 152 as a timing when a longitudinal stripe image occurs. In the embodiment, the predetermined threshold value described above is set as a timing when a total driving time of the photosensitive drum 4 reaches an equivalent of 10,000 sheets with two sheet intermittent feeding. Two sheet intermittent feeding refers to a repeating operation of jobs of forming images consecutively on two sheets of the recording material S. Further, in the embodiment, the control portion 150 resets a count value of the counter 70 to an initial value (0 in the embodiment) when the four drum units 30, which are integrated into a single replacement part, are replaced.

Incidentally, the control portion 150 may control to display information, indicating that the photosensitive drum 4 has reached an end of its lifetime, on an external device such as a personal computer which is communicably connected to the image forming apparatus 1. Further, in the embodiment, an end of a lifetime of the photosensitive drum 4 is detected based on a total driving time of the photosensitive drum 4; however, the present invention is not limited to this method. It is possible to detect an end of a lifetime of the photosensitive drum 4, based on an arbitrary indicator which correlates with a use amount of the photosensitive drum 4. The indicator includes, for example, a total number of revolutions of the photosensitive drum 4, and a total number of prints which is made by using the photosensitive drum 4, other than a total driving time of the photosensitive drum 4. That is, what shows a degree of sliding that the photosensitive drum 4 receives may be used arbitrarily as the indicator.

<Evaluation Tests>

In order to confirm an effectiveness of the embodiment, evaluation tests were conducted on a constitution of the embodiment and that of comparison example 1. As described above, in the embodiment, a film thickness (initial condition) of a surface layer of the photosensitive drum 4Y of the most upstream image forming portion PY is 26 μm, and a film thickness (initial condition) of surface layers of the photosensitive drums 4M, 4C, and 4K of the image forming portions PM, PC, and PK respectively in the downstream side PY is 24 μm. On the other hand, in comparison example 1, a film thickness (initial condition) of surface layers of the photosensitive drums 4Y, 4M, 4C, and 4K of all of the image forming portions PY, PM, PC, and PK respectively is 24 μm. A constitution of comparison example 1 is substantially a same as that of the embodiment, except that the settings of the film thickness of the surface layer of the photosensitive drum 4 are different as described above.

A film thickness of a surface layer of a photosensitive drum is measured by a film thickness measuring device (manufactured by Fisher Instruments, FISCHRSCOPE (registered trademark), mms (registered trademark).

In a constitution of the embodiment and the comparison example, a paper feeding durability test was conducted and an occurrence of longitudinal stripe images in each image forming portions P was checked. The recording material S (paper) which was used for printing was Xerox multipurpose paper manufactured by Xerox (basis weight 75 g/m$^2$, LTR size). Further, the printed image is a horizontal line image (a line extending in a direction substantially perpendicular to a moving direction of the surface of the photosensitive drum 4) with a print ratio of 4% for each color. Whether longitudinal stripe images were occurred was determined by halftone images with a printing ratio of 25% for each color.

The results are shown in Table 1. In Table 1, "NO" indicates no longitudinal stripe images are occurred, "FEW" indicates a few longitudinal stripe images are occurred, and "OCCUR" indicates longitudinal stripe images are occurred. Further, a total driving time of the photosensitive drum 4 is denoted as 100% of a total driving time corresponding to the threshold value (timing of end of lifetime) described above.

TABLE 1

| Longitudinal stripe image | Total driving time of photosensitive drum 0% | 20% | 40% | 60% | 80% | 100% | 120% |
|---|---|---|---|---|---|---|---|
| EMB. 1 | | | | | | | |
| Y Station | NO | NO | NO | NO | NO | NO | FEW |
| M Station | NO | NO | NO | NO | NO | NO | FEW |
| C Station | NO | NO | NO | NO | NO | NO | FEW |
| K Station | NO | NO | NO | NO | NO | NO | FEW |
| COM. 1 | | | | | | | |
| Y Station | NO | NO | NO | NO | FEW | OCCUR | OCCUR |
| M Station | NO | NO | NO | NO | NO | NO | FEW |
| C Station | NO | NO | NO | NO | NO | NO | FEW |
| K Station | NO | NO | NO | NO | NO | NO | FEW |

As shown in Table 1, in the embodiment, any longitudinal stripe images have not been occurred until 100% of the total driving time of the photoreceptor drum 4, which is a timing of reaching a lifetime. On the other hand, in comparison example 1, some longitudinal stripe images have been occurred from a point when the total driving time of the photosensitive drum 4 has reached 80% of the timing of reaching the lifetime.

In a constitution of comparison example 1, an amount of the foreign matter A collected in the most upstream photosensitive drum 4Y is larger, and an abrasion amount of the photosensitive drum 4Y is larger, thus the longitudinal stripe images have been occurred at an earlier timing in the most upstream image forming portion PY than in the image forming portions PM, PC, and PK in the downstream side.

In contrast to this, in the constitution of the embodiment, a film thickness of the surface layer of the photosensitive drum 4Y in the most upstream image forming portion PY is larger than a film thickness of the surface layers of the photosensitive drums 4M, 4C, and 4K in the image forming portions PM, PC, and PK respectively in the downstream side. In this way, in the constitution of the embodiment, it is possible to suppress occurrences of longitudinal stripe images within the set lifetime in all of the image forming portions PY, PM, PC, and PK. Incidentally, the paper feeding durability test was conducted until a total driving time of the photosensitive drum 4 exceeded 100%, which is a timing of reaching an end of a lifetime. As a result, at 120% of a timing of reaching an end of a lifetime, "FEW" rank longitudinal stripe images are occurred in all of the image forming portions PY, PM, PC, and PK.

As described above, the image forming apparatus 1 in the embodiment, includes the belt 12, which is urged with a first image bearing member 4Y and forms the first transfer portion NY, the belt 12 nipping and feeding the recording material S between itself and the first image bearing member 4Y and between itself and the second image bearing members 4M, 4C, and 4K in the first transfer portion NY and the second transfer portions NM, NC, and NK, respectively, where the belt 12 which forms the second transfer portions NM, NC, and NK is urged with the second image bearing member 4M, 4C, and 4K, wherein the first image forming portion 4Y is disposed upstream of the second image forming portions 4M, 4C, and 4K with respect to a moving direction of the recording material S, and a plurality of members, including the first image bearing member 4Y and the second image bearing members 4M, 4C, and 4K, are integrally assembled and are mountable on or dismountable from the main assembly 2 of the image forming apparatus 1. And, in the embodiment, a film thickness of the surface of the first image bearing member 4Y is larger than a film thickness of the surfaces of the second image bearing members 4M, 4C, and 4K.

According to the embodiment, it is possible to make the film thicknesses of the surface layers of the photosensitive drums 4 substantially the same for the photosensitive drum 4Y on the upstream side and the photosensitive drums 4M, 4C, and 4K on the downstream side. This is, it is possible to reduce a difference in remaining film thicknesses of the surface layers among the photosensitive drums 4. In this way, it is possible to extend an overall lifetime of the plurality of the drum units 30, which are integrated and made into a single replacement part.

Embodiment 2

Next, another embodiment of the present invention will be described. A basic constitution and operation of the image forming apparatus in the embodiment 2 is the same as the image forming apparatus in the embodiment 1. Accordingly, in the image forming apparatus of the embodiment 2, elements having the same or corresponding functions or constitutions as those in the image forming apparatus in the embodiment 1 will be represented by the same symbols and detailed descriptions will be omitted.

In the embodiment, a peripheral speed of the developing roller 6Y in the most upstream image forming portion PY is set to be slower than a peripheral speed of the developing rollers 6M, 6C, and 6K on the downstream side. Incidentally, the film thicknesses of the surface layers of the photosensitive drums 4Y, 4M, 4C, and 4K on the most upstream and the downstream are all the same at 24 μm. By lowering the peripheral speed of the developing roller 6Y in the most upstream image forming portion PY, it is possible to suppress an abrasion amount of the most upstream photosensitive drum 4Y. This is because when the peripheral speed of the developing roller 6Y is decreased, a force, which is caused by the photosensitive drum 4Y sliding against the foreign matter A interposed between the developing roller 6Y and the photosensitive drum 4Y, is reduced.

According to the constitution of the embodiment, it is possible to suppress an abrasion amount of the most upstream photosensitive drum 4Y and match abrasion amounts of the photosensitive drums 4M, 4C, and 4K in the downstream side. That is, a time when the most upstream photosensitive drum 4Y reaches an end of its lifetime and a time when the photosensitive drums 4M, 4C, and 4K in the downstream side reach ends of their lifetime are become closer, and each drum unit 30 reaches an end of its lifetime at an almost same time. As a result, it is possible to extend an overall lifetime of the four drum units 30, which are integrated into a single replacement part.

In the embodiment, a peripheral speed of the developing roller 6Y in the most upstream image forming portion PY is set to 120 mm/sec, and a peripheral speed of the developing rollers 6M, 6C, and 6K in the image forming portions PM, PC, and PK on the downstream side is set to 150 mm/sec. That is, in the embodiment, the peripheral speeds of the developing rollers 6M, 6C, and 6K in the image forming portions PM, PC, and PK on in the downstream side are the same as in the embodiment 1, and the peripheral speed of the developing roller 6Y in the most upstream image forming portion PY is slower than that in the embodiment 1.

Figure 6:
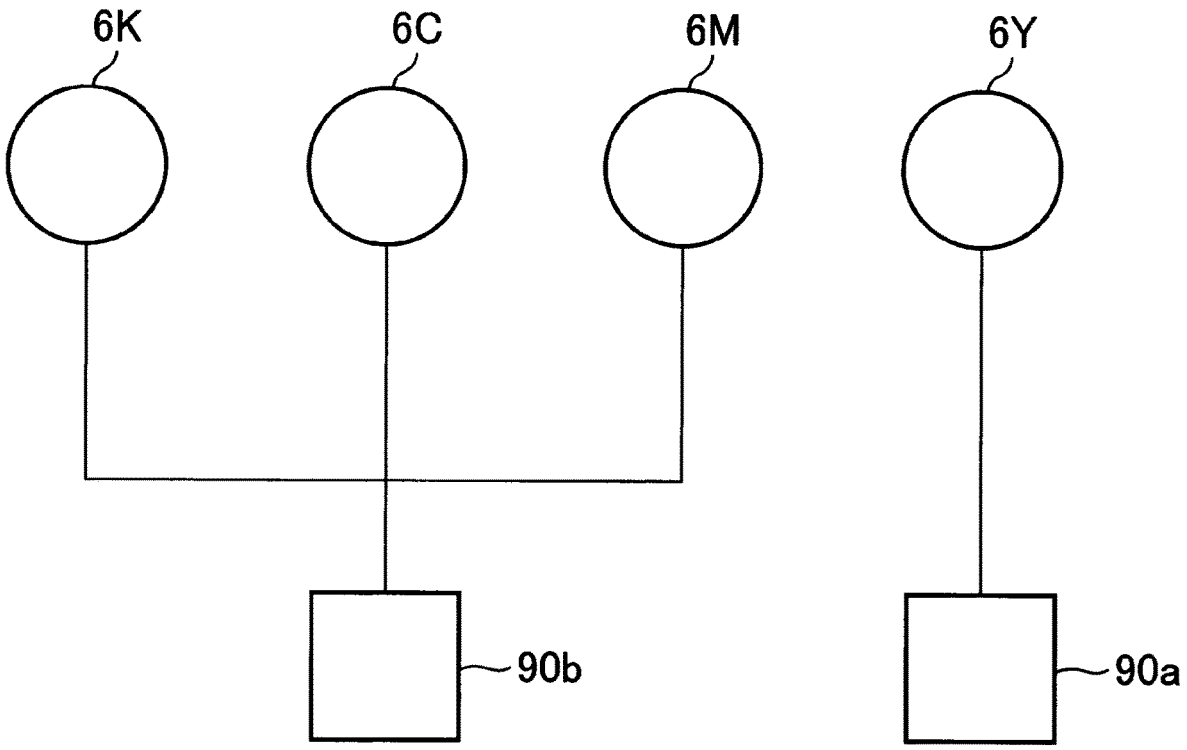
FIG. 6 is a schematic diagram showing one of examples of a driving configuration of a developing device.

A constitution for changing the peripheral speed of the developing roller 6 in the embodiment will be described. FIG. 6 is a schematic view showing a driving constitution of the developing roller 6. In the embodiment, the image forming apparatus 1 includes a first driving means and a second driving means separately as a driving means to rotate the developing roller 6. First, a first developing driving motor 90*a* as the first driving means to drives the developing roller 6Y in the most upstream image forming portion PY. Further, a second developing driving motor 90*b* as the second driving means drives the developing rollers 6M, 6C, and 6K in the image forming portions PM, PC and PK on the downstream side, respectively. In this way, it is possible to change the peripheral speeds of the developing roller 6Y in the most upstream image forming portion PY and the developing rollers 6M, 6C, and 6K in the image forming portions PM, PC, and PK on the downstream side by each developing driving motor 90*a* and 90*b*.

Incidentally, the constitution for changing the peripheral speed of the developing roller 6 is not limited to the constitution in the embodiment. For example, while the driving motor of the developing roller 6 is common, a gear ratio of gears from the driving motor to the developing roller 6 may be changed among the most upstream image forming portion PY and the image forming portions PM, PC, and PK in the downstream side. In this way, it is also possible to change the peripheral speeds among the developing roller 6Y in the most upstream image forming portion PY and the developing rollers 6M, 6C, and 6K in the image forming portions PM, PC, and PK, respectively.

In order to check an effectiveness of the embodiment, evaluation tests were conducted on constitutions of the embodiment and comparison example 2. As described above, in the embodiment, a peripheral speed of the developing roller 6Y in the most upstream image forming portion PY is 120 mm/sec, and peripheral speeds of the developing rollers 6M, 6C, and 6K in the image forming portions PM, PC, and PK, respectively, on the downstream side are 150 mm/sec. On the other hand, in comparison example 2, peripheral speeds of the developing rollers 6Y, 6M, 6C, and 6K in all of image forming portions PY, PM, PC, and PK, respectively, are 150 mm/sec. The constitution of the comparison example 2 is substantially the same as that of the embodiment, except that a setting of the peripheral speed of the developing roller 6 is different as described above.

In the constitutions of the embodiment and the comparison example 2, paper feeding durability tests were conducted and whether or not longitudinal stripe images were occurred in the most upstream image forming portion PY was checked. The recording material S (paper) used for printing was Xerox multipurpose paper manufactured by Xerox (basis weight 75 g/m$^2$, LTR size). Further, the printed image is a horizontal line image with a print ratio of 4% for each color. Whether or not longitudinal stripe images were occurred, was determined by using secondary color halftone images of yellow and magenta each with a print ratio of 25%.

The results are shown in Table 2. In Table 2, "NO" indicates no longitudinal stripe images are occurred, "FEW" indicates a few longitudinal stripe images are occurred, and "OCCUR" indicates longitudinal stripe images are occurred. Further, a total driving time of the photosensitive drum 4 is denoted as 100% of a total driving time corresponding to the threshold value (timing of end of lifetime) described in the embodiment 1.

TABLE 2

| Longitudinal stripe image of photosensitive drum 4 | Total driving time of photosensitive drum 4 | | | | | |
|---|---|---|---|---|---|---|
| | 0% | 20% | 40% | 60% | 80% | 100% |
| EMB. 2 | NO | NO | NO | NO | NO | NO |
| COM. 1 | NO | NO | NO | NO | FEW | OCCUR |

As shown in Table 2, in the embodiment, no longitudinal stripe images have been occurred until a total driving time of the photosensitive drum 4 reaches 100%, which is a timing of an end of its lifetime. On the other hand, in the comparison example 2, some longitudinal stripe images have been occurred at a time when a total driving time of the photosensitive drum 4 reaches 80% of a timing of an end of its lifetime.

In the constitution of the comparison example 2, an amount of the foreign matter A collected in the most upstream photosensitive drum 4Y is large, so an abrasion amount of the photosensitive drum 4Y is large, then longitudinal stripe images have been occurred in the most upstream image forming portion PY.

In contrast to this, in the constitution of the embodiment, a peripheral speed of the developing roller 6Y of the most upstream image forming portion PY is set slower than peripheral speeds of the developing rollers 6M, 6C, and 6Y in the image forming portions PM, PC, and PK respectively in the downstream side. In this way, in the constitution of the embodiment, an abrasion amount of the most upstream photosensitive drum 4Y has been reduced, and it is possible to suppress an occurrence of longitudinal stripe images.

Incidentally, in the embodiment, an abrasion amount of the most upstream photosensitive drum 4Y is suppressed by slowing a peripheral speed of the developing roller 6Y in the most upstream image forming portion PY, however, the present invention is not limited to this method.

For example, it is also possible to suppress an abrasion amount of the most upstream photosensitive drum 4Y by lowering an urging pressure of the developing roller 6Y against the photosensitive drum 4Y in the most upstream photosensitive portion PY. This also reduces the force which is caused by the photoreceptor drum 4Y sliding against the foreign matter A interposed between the developing roller 6Y and the photosensitive drum 4Y. That is, the urging pressure when the developing roller 6Y is urged with the photosensitive drum 4Y in the most upstream image forming portion PY is set lower than urging pressures when the developing rollers 6M, 6C, and 6K are urged with the photosensitive drums 4M, 4C, and 4K in the image forming portions PM, PC, and PK on the downstream side. In this way, it is possible to suppress the abrasion amount of the most upstream photosensitive drum 4Y, and match the abrasion amounts of the photosensitive drums 4M, 4C, and 4K on the downstream side.

Figure 7:
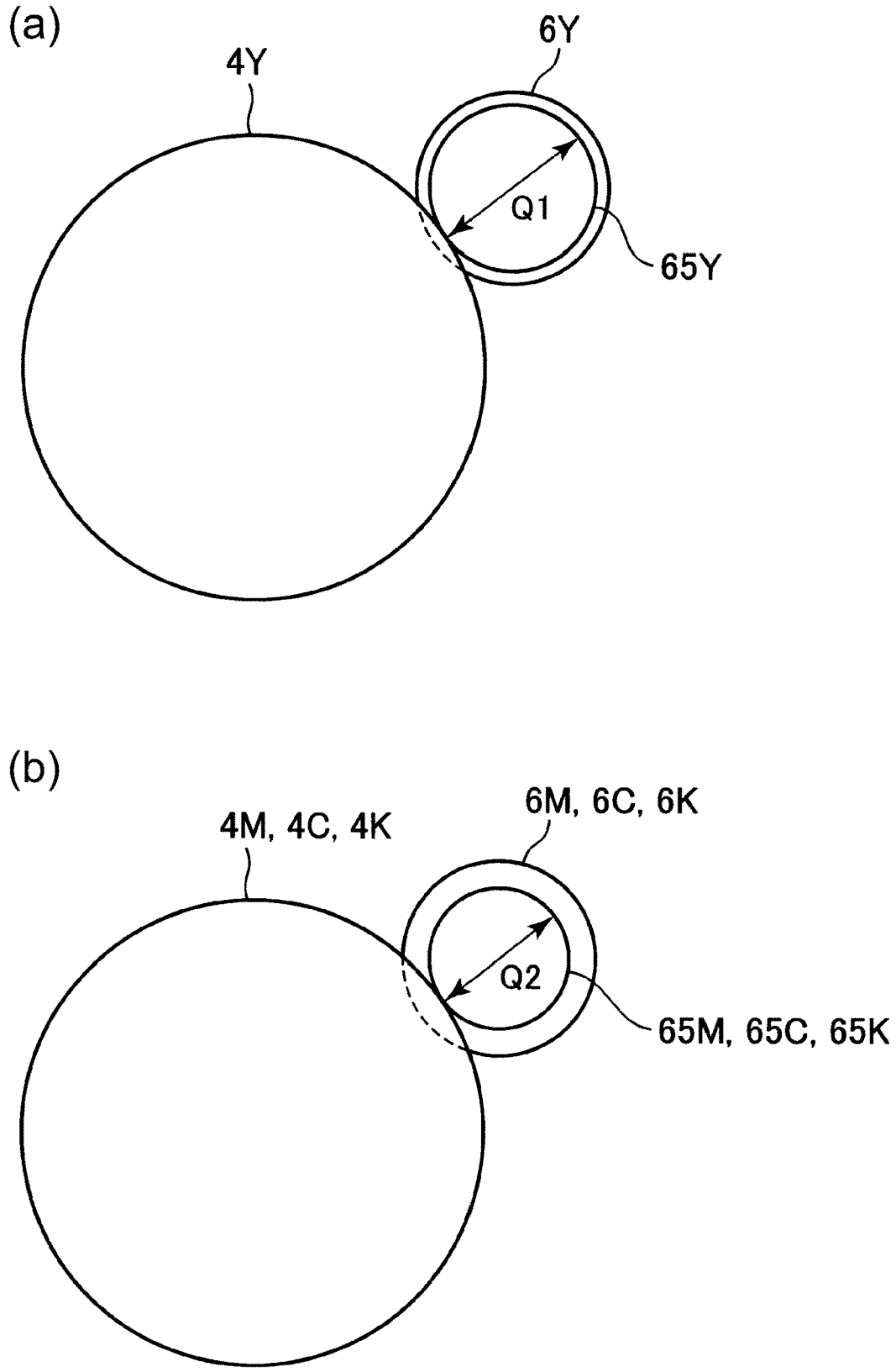
FIG. 7, part (a) and part (b), is a schematic diagram showing one of examples of a configuration which determines a contact pressure of a developing roller.

Specifically, it is possible to change the urging pressure by changing a distance between rotational centers of the photosensitive drum 4 and the developing roller 6, which determines the urging pressure of the developing roller 6 against the photosensitive drum 4. That is, the distance between the rotational centers described above in the most upstream image forming portion PY is set wider than the distance between the rotational centers described above in the image forming portions PM, PC, and PK in the downstream. It is possible to determine the distance between the rotational centers described above, for example, as follows. FIG. 7 is a schematic sectional view showing an example of a constitution for determining the distance between the rotational centers described above. The developing cartridge 8 is urged by a spring (not shown), etc., which is an urging member as an urging means, so that the developing roller 6 is pressed by the photosensitive drum 4. Further, a roller 65 is provided at both end portions in a longitudinal direction of a roller shaft of the developing roller 6, as a regulating member which is urged with the photosensitive drum 4 and determines a depth that a rubber layer of the developing roller 6 enters into the photosensitive drum 4. Then, an outer diameter Q1 (part (a) of FIG. 7) of a roller 65Y as a first regulating member in the most upstream image forming portion PY is set larger than an outer diameter Q2 (part (b) of FIG. 7) of rollers 65M, 65C, and 65K as a second regulating member in the image forming portions PM, PC, and PK in the downstream side. Further, it is also possible to determine the distance between the rotational centers described above, for example, by providing a positioning member in the developer frame 28, which is urged with the photosensitive drum 4 and determines the depth that the rubber layer of the developing roller 6 intrudes into the photosensitive drum 4.

As described above, the image forming apparatus 1 in the embodiment includes a driving means which rotates a first developer carrying member 6Y and a second developer carrying member 6M, 6C, and 6K. The driving means rotates so that the first image bearing member 4Y and the first developer carrying member 6Y move in a same direction as each other in an opposing portion of the first image bearing member 4Y and the first developer carrying member 6Y, and that the second image bearing members 4M, 4C, and 4K and the second developer carrying members 6M, 6C, and 6K move in same directions as each other in opposing portions of the second image bearing members 4M, 4C, and 4K and the second developer carrying members 6M, 6C, and 6K. And in the embodiment, a first peripheral speed ratio which is a peripheral speed ratio of the first developer carrying member 6Y to a peripheral speed of the first image bearing member 4Y is smaller than a second peripheral speed ratio which is a peripheral speed ratio of the second developer carrying members 6M, 6C, and 6K to a peripheral speed of the second image bearing members 4M, 4C, and 4K. For example, a gear ratio of a first gear which is provided between the first developer carrying member 6Y and the driving means described above and a gear ratio of a second gear which is provided between the second developer carrying members 6M, 6C, and 6K and the driving means described above may be different. Or the driving means described above may include a first driving means which rotates the first developer carrying member 6Y and a second driving means which rotates the second developer carrying members 6M, 6C, and 6K, separately, and a driving speed of the first developer carrying member 6Y by the first driving means and a driving speed of the second developer carrying members 6M, 6C, and 6K by the second driving means may be different.

Further, as another method, a first urging pressure when the first image bearing member 4Y is urged with the first developer carrying member 6Y, may be smaller than a second urging pressure when the second image bearing members 4M, 4C, and 4K is urged with the second developer carrying members 6M, 6C, and 6K. In the embodiment, the first developer carrying member 6Y and the second developer carrying members 6M, 6C, and 6K are rollers with elastic layers which are formed around core shafts, respectively, and a distance between the core shafts described above of the first image bearing member 4Y and the first developer carrying member 6Y when the first image bearing member 4Y is urged with the first developer carrying member 6Y is larger than a distance between the core shafts described above of the second image bearing members 4M, 4C, and 4K and the second developer carrying members 6M, 6C, and 6K when the second image bearing members 4M, 4C, and 4K are urged with the second developer carrying members 6M, 6C, and 6K. For example, the first urging pressure described above may be determined by urging of the first regulating member 65Y which is arranged at both end portions with respect to the longitudinal direction of the first developer carrying member 6Y with the first image bearing member 4Y, and the second urging pressure described above may be determined by urging of the second regulating members 65M, 65C, and 65K which are arranged at both end portions with respect to the longitudinal directions of the second developer carrying members 6M, 6C, and 6K with the second image bearing member 4M, 4C, and 4K. Or the first urging pressure described above may be determined by urging of a first positioning member, provided with a frame 28Y which constitutes the first developing device 8Y, with the first image bearing member 4Y, and the second urging pressure described above may be determined by urging of second positioning members, provided with frames 28M, 28C, and 28K which constitute the second developing device 8M, 8C, and 8K, with the second image bearing members 4M, 4C, and 4K.

According to the embodiment, it is possible to suppress the abrasion amount of the photosensitive drum 4Y in the upstream side, and match the abrasion amounts of the photosensitive drums 4M, 4C, and 4K in the downstream side. In this way, it is possible to extend an overall lifetime of the plurality of drum units 30, which are integrated and made into a single replacement part. Further, according to the embodiment, it is possible to suppress the abrasion amount of the most upstream photosensitive drum 4Y, while suppressing a decrease in density of a yellow image which is formed in the most upstream imaging portion PY, compared to the constitution of the embodiment 1.

Embodiment 3

Next, another embodiment of the present invention will be described. A basic constitution and operation of the image forming apparatus in the embodiment 3 is the same as the image forming apparatus in the embodiment 1. Accordingly, in the image forming apparatus of the embodiment 3, elements having the same or corresponding functions or constitutions as those in the image forming apparatus in the embodiment 1 will be represented by the same symbols and detailed descriptions will be omitted.

Figure 8:
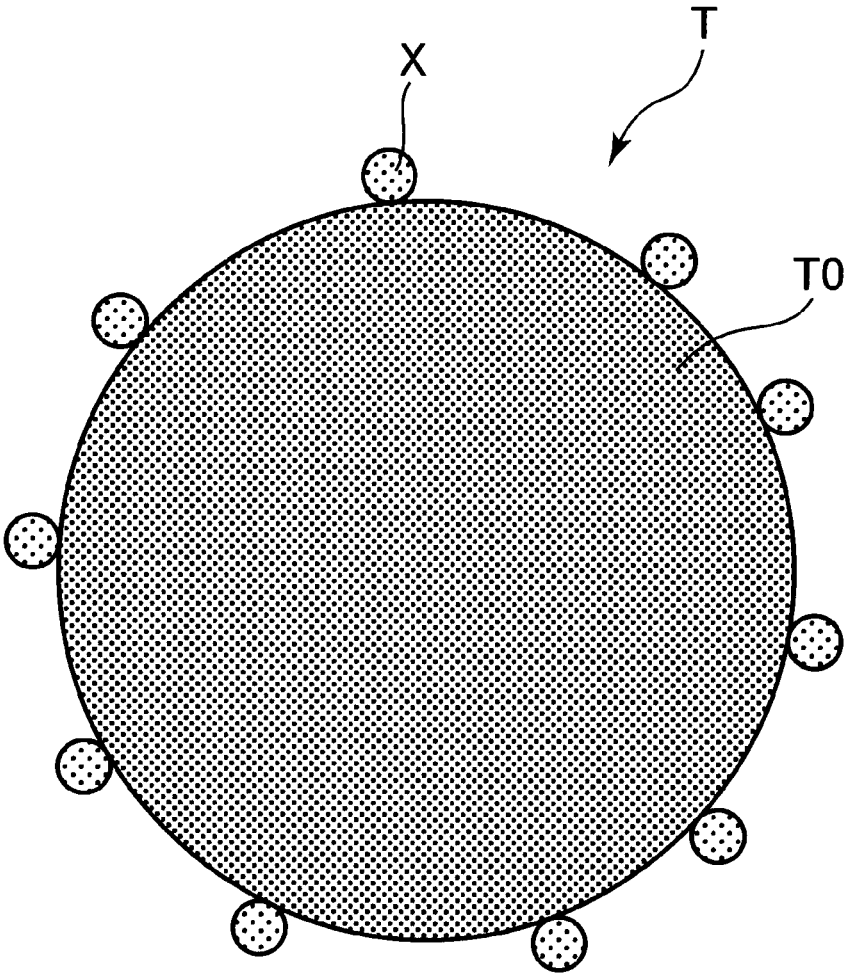
FIG. 8 is a schematic diagram showing a developer containing a metallic soap.

First, a constitution of a developer T which is used in the embodiment will be described with reference to FIG. 8. FIG. 8 is a diagram showing an example of a sectional structure of the toner T. Incidentally, FIG. 8 schematically shows main components of the developer (toner) T in order to make it easier to understand a constitution of the developer T. A size, number, shape, etc., of each component shown in FIG. 8 may differ from actual ones for a convenience of drawing. The developer T shown in FIG. 8 includes a developer mother particle (toner matrix particle) T0 and a metallic soap (metallic soap particle) X which is attached to a surface of the developer mother particle T0.

As metallic soaps, higher fatty acid salts of various metals suitable as external additives to developer mother particles T0 may be used. Metallic soap is a general term for metallic salts of long-chain fatty acids and metals other than sodium and potassium. Concretely, fatty acids such as stearic acid, myristic acid, lauric acid, ricinoleic acid, and octyl acid, and metallic salts of metal species such as lithium, magnesium, calcium, barium, and zinc are included. In the embodiment, zinc stearate is externally added as a metallic soap. Incidentally, types of metallic soaps are not limited to this, but lead stearate, cadmium stearate, barium stearate, calcium stearate, aluminum stearate, zinc stearate, magnesium stearate, zinc laurate, zinc myristate, etc., may be appropriately used. At least one of these may be selected and used. Typically, an average particle size of the metallic soap X is smaller than an average particle size of the developer mother particle T0. For example, an average particle diameter of the developer mother particle T0 is typically about 5 μm or more, but not more than 8 μm. An average particle size of the metallic soap is typically about 0.15 μm or more, but not more than 2.0 μm. Incidentally, as for the metallic soap X, a single component may be used independently, or a combination of two or more components may be used.

In the embodiment, only the developer T in which the most upstream developer cartridge 8Y accommodates includes the metallic soap X, and the developer T in which the developer cartridges 8M, 8C, and 8K in the downstream side accommodate do not include the metallic soap X. Incidentally, in the embodiment, a film thickness of the surface layers of the photosensitive drums 4Y, 4M, 4C, and 4K in the most upstream and downstream side are all the same of 24 μm. It is possible to suppress an abrasion amount of the most upstream photosensitive drum 4Y by including the metallic soap X in the developer T in which the most upstream developer cartridge 8Y accommodates. This is due to a following action. That is, when the developer T moves to the photosensitive drum 4Y, the metallic soap X which is attached to a surface of the developer T moves to the photosensitive drum 4 Y and acts as a lubricant. In this way, it is possible to reduce the force with which the photosensitive drum 4Y is slid by the foreign matter A.

According to the constitution of the embodiment, it is possible to suppress the abrasion amount of the most upstream photosensitive drum 4Y and match the abrasion amount of the photosensitive drums 4M, 4C, and 4K in the downstream side. That is, a time when the most upstream photosensitive drum 4Y reaches an end of its lifetime and a time when the photosensitive drums 4M, 4C, and 4K in the downstream side reach ends of their lifetime are become closer, and each drum unit 30 reaches an end of its lifetime at an almost same time. As a result, it is possible to extend an overall lifetime of the four drum units 30, which are integrated into a single replacement part.

In the embodiment, a content of the metallic soap X (ratio of mass of the metallic soap X per unit mass of the developer T (mass ratio)) in the developer T (developer mother particle T0, metallic soap X) is set as follows. That is, the developer T in which the most upstream developer cartridge 8Y accommodates is set to 0.05 mass % and the developer T in which the developer cartridges 8M, 8C, and 8K in the downstream side accommodate are set to 0 mass %. When the content of the metallic soap in the developer T is too small, an effect of reducing the abrasive amount of the photosensitive drum 4 may be difficult to exhibit, on the other hand, when the content of the metallic soap is too large, it may have some effects such as a fluidity decline of the developer T.

Incidentally, the content of metallic soap X is measured by a wavelength dispersive X-ray fluorescence spectrometer "Axios" (manufactured by PANalytical). Further, settings of measuring conditions and analysis of measured data are using an accompanying specialized software "SuperQ ver.4.0F" (manufactured by PANalytical).

In order to check an effectiveness of the embodiment, evaluation tests were conducted on configurations of the embodiment and a comparison example 3. As described above, in the embodiment, the content of metallic soap X in the developer T is 0.05 mass % in the most upstream developer cartridge 8Y, and 0 mass % in the developer cartridges 8M, 8C and 8K on the downstream side. On the other hand, in comparison example 3, the content of metallic soap X in the developer T is set to 0 mass % in all the developer cartridges 8Y, 8M, 8C, and 8 K. The constitution of comparison example 3 is substantially the same as that of the embodiment, except that the constitution of the developer T is different as described above.

And in the constitutions of the embodiment and comparison example 3, paper feeding durability tests were conducted and whether or not longitudinal stripe images were occurred in the most upstream image forming portion PY was checked. The recording material S (paper) used for printing was Xerox multipurpose paper manufactured by Xerox (basis weight 75 g/m$^2$, LTR size). Further, the printed image is a horizontal line image with a print ratio of 4% for each color. Whether or not longitudinal stripe images were occurred, was determined by using secondary color halftone images of yellow and magenta each with a print ratio of 25%.

The results are shown in Table 3. In Table 3, "NO" indicates no longitudinal stripe images are occurred, "FEW" indicates a few longitudinal stripe images are occurred, and "OCCUR" indicates longitudinal stripe images are occurred. Further, a total driving time of the photosensitive drum 4 is denoted as 100% of a total driving time corresponding to the threshold value (timing of end of lifetime) described in the embodiment 1.

TABLE 3

| Longitudinal stripe image of photosensitive | Total driving time of photosensitive drum 4 | | | | | |
|---|---|---|---|---|---|---|
| drum 4Y | 0% | 20% | 40% | 60% | 80% | 100% |
| EMB. 3 | NO | NO | NO | NO | NO | NO |
| COM. 3 | NO | NO | NO | NO | FEW | OCCUR |

As shown in Table 3, in the embodiment, no longitudinal stripe images occurred until 100% of the total driving time of the photosensitive drum 4, which is a timing of reaching a lifetime. On the other hand, in the comparison example 3, some longitudinal stripe images occurred at a time when a total driving time of the photosensitive drum 4 reached 80% of its lifetime.

In the constitution of the comparison example 3, an amount of the foreign matter A collected in the most upstream photosensitive drum 4Y is large, so an abrasion amount of the photosensitive drum 4Y is large, then longitudinal stripe images have been occurred in the most upstream image forming portion PY.

In contrast to this, in the constitution of the embodiment, the amount of the metallic soap X per unit mass of the developer T which is accommodated in the most upstream developer cartridge 8Y is larger than the amount of metallic soap X per unit mass of the developer T which is accommodated in the developer cartridges 8M, 8C, and 8K. In this way, in the constitution of the embodiment, an abrasion amount of the most upstream photosensitive drum 4Y has been reduced, and it is possible to suppress an occurrence of longitudinal stripe images.

Incidentally, a constitution in which the developer T, accommodated in the developer cartridges 8M, 8C, and 8K on the downstream side, does not include the metallic soap X is shown in the embodiment; however, the present invention is not limited to this method. For example, it may be a constitution in which the content of the metallic soap X in the developer T, accommodated in the most upstream developer cartridge 8Y, is larger than the content of the metallic soap X in the developer T accommodated in the developer cartridges 8M, 8C, and 8K on the downstream side. With an amount of metallic soap X as a lubricant which moves to the photosensitive drum 4, the effect of reducing the force with which the most upstream photosensitive drum 4Y is slid by the foreign matter A should be greater than the effect of reducing the force with which the photosensitive drums 4M, 4C, and 4K in the downstream side are slid by the foreign matter A. That is, by suppressing the abrasion amount of the most upstream photosensitive drum 4Y, it should match the abrasion amount of the photosensitive drums 4M, 4C, and 4K on downstream side.

As described above, in the embodiment, a first developer which is accommodated in the first developer device 8Y is provided with a developer mother particle and a metallic soap attached to a surface of the developer mother particle, a second developer which is accommodated in the second developer devices 8M, 8C, and 8K is provided with at least the developer mother particle among the developer mother particle and the metallic soap, and a first mass ratio of a mass of the metallic soap per unit mass of the first developer is larger than a second mass ratio of a mass of the metallic soap per unit mass of the second developer. Particularly, in the embodiment, the first developer is provided with the metallic soap and the second developer does not include the metallic soap.

According to the embodiment, it is possible to suppress the abrasion amount of the photosensitive drum 4Y in the upstream side, and match the abrasion amounts of the photosensitive drums 4M, 4C, and 4K in the downstream side. In this way, it is possible to extend an overall lifetime of the plurality of drum units 30, which are integrated into a single replacement part.

OTHER

As above, the present invention was described in accordance with the specific embodiments, however, the present invention is not limited to the embodiments described above.

In the embodiments described above, the foreign matter collecting member is provided only in the most upstream image forming portion, however, the foreign matter collecting members may be provided in the image forming portions in the downstream side. In such a constitution, most of the foreign matter which easily moves to the image bearing member is collected on the most upstream image bearing member, so it may cause similar problems as in the embodiments described above. Thus, in such a constitution, by applying the present invention, it is possible to obtain similar effects as in the embodiments described above Further, in the embodiments described above, the charging voltage and the developing voltage are described only for a DC voltage component, however, the charging voltage and the developing voltage may be an oscillation voltage which is superimposed with a DC voltage (DC component)

and an AC voltage (AC component), respectively. This also applies to the collecting voltage and the discharging voltage.

Further, in the embodiments described above, a static eliminating light source is used as a static eliminating means, however, a static eliminating means may not be provided in a case of, for example, using a charging means that a charging irregularity is sufficiently low.

Further, in the embodiments described above, a one-component non-magnetic contact developing method is used; however, the present invention is not limited to such a method, and a two-component non-magnetic contact developing method, non-contact developing method, magnetic developing method, etc., may also be used.

Further, in the embodiments described above, the cleaning member is a rotatable roller shaped member, however, it may be, for example, a rotatable brush shaped member (brush roller). Further, in the embodiments described above, the foreign matter collecting member is a rotatable roller shaped member, however, it may be, for example, a rotatable brush shaped member (brush roller).

Further, in the embodiments described above, the image bearing member is a rotatable drum shaped member, however, it may be, for example, an endless belt. Further, in the embodiments above, the transfer member is a rotatable roller shaped member, however, it is not limited to this. For example, it may be a pad shaped member, a sheet shaped member, a brush shaped member (fixed brush, rotatable brush roller, etc.), or a rotatable, endless belt (an urging member may be provided to urge a photosensitive member via a belt). Further, the charging member may be a rotatable roller shaped member, a brush shaped member (rotatable brush roller, etc.), or a rotatable endless belt.

Further, in the embodiment described above, the image forming apparatus includes four image forming portions, however, a number of image forming portions is not limited to four. The number of the image forming portions is required to be two or more according to a number of colors used, for example, it may be three or, five or more.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-025744 filed on Feb. 19, 2021, which is hereby incorporated by reference herein in its entirety.

What is claimed is:

1. An image forming apparatus capable of performing an image forming operation in which an image is formed on a recording material, said image forming apparatus comprising:

a first image forming portion including a first image bearing member rotatably movable and including a photosensitive layer, a first charging member configured to charge a surface of said first image bearing member, a first developing device configured to supply a first developer onto the surface of said first image bearing member, a first transferring member configured to transfer the first developer supplied to the surface of said first image bearing member to the recording material, a first cleaning member configured to clean the surface of said first image bearing member in contact with said first image bearing member, and a first collecting member configured to collect foreign matter deposited on said first cleaning member;

a second image forming portion including a second image bearing member rotatably movable and including a photosensitive layer, a second charging member configured to charge a surface of said second image bearing member, a second developing device configured to supply a second developer onto the surface of said second image bearing member, a second transferring member configured to transfer the second developer supplied to the surface of said second image bearing member to the recording material, and a second cleaning member configured to clean the surface of said second image bearing member in contact with said second image bearing member; and a belt configured to form a first transferring portion in contact with said first image bearing member and to form a second transferring portion in contact with said second image bearing member, said belt nipping and feeding the recording material between said belt and said first image bearing member and between said belt and said second image bearing member in said first transferring portion and said second transferring portion, respectively, wherein said first image forming portion is disposed upstream of said second image forming portion with respect to a moving direction of the recording material, and a plurality of members including said first image bearing member and said second image bearing member are integrally assembled and are mountable on or dismountable from a main assembly of said image forming apparatus, and wherein a film thickness of the surface of said first image bearing member is larger than a film thickness of the surface of said second image bearing member.

2. An image forming apparatus according to claim 1, wherein said second image forming portion is not provided with a collecting member configured to collect foreign matter deposited on said second cleaning member.

3. An image forming apparatus capable of performing an image forming operation in which an image is formed on a recording material, said image forming apparatus comprising:

a first image forming portion including a first rotatable image bearing member, a first charging member configured to charge a surface of said first image bearing member, a first developing device configured to supply a first developer onto the surface of said first image bearing member by a first developer carrying member, a first transferring member configured to transfer the first developer supplied to the surface of said first image bearing member to the recording material, a first cleaning member configured to clean the surface of said first image bearing member in contact with said first image bearing member, and a first collecting member configured to collect foreign matter deposited on said first cleaning member;

a second image forming portion including a second rotatable image bearing member, a second charging member configured to charge a surface of said second image bearing member, a second developing device configured to supply a second developer onto the surface of said second image bearing member by a second developer carrying member, a second transferring member configured to transfer the second developer supplied to the surface of said second image bearing member to the recording material, and a second cleaning member configured to clean the surface of said second image bearing member in contact with said second image bearing member;

a belt configured to form a first transferring portion in contact with said first image bearing member and to form a second transferring portion in contact with said second image bearing member, said belt nipping and feeding the recording material between said belt and said first image bearing member and between said belt and said second image bearing member in said first transferring portion and said second transferring portion, respectively; and a driving portion configured to rotate said first developer carrying member and said second developer carrying member such that said first image bearing member and said first developer carrying member move in the same direction as each other in an opposing portion between said first image bearing member and said first developer carrying member and such that said second image bearing member and said second developer carrying member move in the same direction as each other in an opposing portion between said second image bearing member and said second developer carrying member, wherein said first image forming portion is disposed upstream of said second image forming portion with respect to a moving direction of the recording material, and a plurality of members including said first image bearing member and said second image bearing member are integrally assembled and are mountable on or dismountable from a main assembly of said image forming apparatus, and wherein a first circumferential speed ratio of a circumferential speed of said first developer carrying member to a circumferential speed of said first image bearing member is less than a second circumferential speed ratio of a circumferential speed of said second developer carrying member to a circumferential speed of said second image bearing member.

4. An image forming apparatus according to claim 3, wherein a gear ratio of a first gear provided between said first developer carrying member and said driving portion is different from a gear ratio of a second gear provided between said second developer carrying member and said driving portion.

5. An image forming apparatus according to claim 3, wherein said driving portion separately includes a first driving portion for rotating said first developer carrying member and a second driving portion for rotating said second developer carrying member, and wherein a driving speed of said first developer carrying member by said first driving portion is different from a driving speed of said second developer carrying member by said second driving portion.

6. An image forming apparatus according to claim 3, wherein said second image forming portion is not provided with a collecting member configured to collect foreign matter deposited on said second cleaning member.

7. An image forming apparatus capable of performing an image forming operation in which an image is formed on a recording material, said image forming apparatus comprising:

a first image forming portion including a first rotatable image bearing member, a first charging member configured to charge a surface of said first image bearing member, a first developing device configured to supply a first developer onto the surface of said first image bearing member by a first developer carrying member, a first transferring member configured to transfer the first developer supplied to the surface of said first image bearing member to the recording material, a first cleaning member configured to clean the surface of said first image bearing member in contact with said first image bearing member, and a first collecting member configured to collect foreign matter deposited on said first cleaning member;

a second image forming portion including a second rotatable image bearing member, a second charging member configured to charge a surface of said second image bearing member, a second developing device configured to supply a second developer onto the surface of said second image bearing member by a second developer carrying member, a second transferring member configured to transfer the second developer supplied to the surface of said second image bearing member to the recording material, and a second cleaning member configured to clean the surface of said second image bearing member in contact with said second image bearing member; and a belt configured to form a first transferring portion in contact with said first image bearing member and to form a second transferring portion in contact with said second image bearing member, said belt nipping and feeding the recording material between said belt and said first image bearing member and between said belt and said second image bearing member in said first transferring portion and said second transferring portion, respectively, wherein said first image forming portion is disposed upstream of said second image forming portion with respect to a moving direction of the recording material, and a plurality of members including said first image bearing member and said second image bearing member are integrally assembled and are mountable on or dismountable from a main assembly of said image forming apparatus, and wherein a first contact pressure when said first image bearing member and said first developer carrying member are contacted is less than a second contact pressure when said second image bearing member and said second developer carrying member are contacted.

8. An image forming apparatus according to claim 7, wherein said first developer carrying member and said second developer carrying member include a roller with an elastic layer around its core shaft, respectively, and wherein a distance between said first image bearing member and the core shaft of said first developer carrying member when said first image bearing member and said first developer carrying member are contacted is longer than a distance between said second image bearing member and the core shaft of said second developer carrying member when said second image bearing member and said second developer carrying member are contacted.

9. An image forming apparatus according to claim 8, wherein the first contact pressure is determined by a first regulating member, disposed at both ends with respect to a longitudinal direction of said first developer carrying member, being contacted to said first image bearing member, and the second contact pressure is determined by a second regulating member, disposed at both ends with respect to a longitudinal direction of said second developer carrying member, being contacted to said second image bearing member.

10. An image forming apparatus according to claim 8, wherein the first contact pressure is determined by a first positioning member, provided on a frame constituting said first developing device, being contacted to said first image bearing member, and the second contact pressure is determined by a second positioning member, provided on a frame constituting said second developing device, being contacted to said second image bearing member.

11. An image forming apparatus according to claim 7, wherein said second image forming portion is not provided with a collecting member configured to collect foreign matter deposited on said second cleaning member.

12. An image forming apparatus capable of performing an image forming operation in which an image is formed on a recording material, said image forming apparatus comprising:

a first image forming portion including a first rotatable image bearing member, a first charging member configured to charge a surface of said first image bearing member, a first developing device configured to supply a first developer onto the surface of said first image bearing member, a first transferring member configured to transfer the first developer supplied to the surface of said first image bearing member to the recording material, a first cleaning member configured to clean the surface of said first image bearing member in contact with said first image bearing member, and a first collecting member configured to collect foreign matter deposited on said first cleaning member;

a second image forming portion including a second rotatable image bearing member, a second charging member configured to charge a surface of said second image bearing member, a second developing device configured to supply a second developer onto the surface of said second image bearing member, a second transferring member configured to transfer the second developer supplied to the surface of said second image bearing member to the recording material, and a second cleaning member configured to clean the surface of said second image bearing member in contact with said second image bearing member; and a belt configured to form a first transferring portion in contact with said first image bearing member and to form a second transferring portion in contact with said second image bearing member, said belt nipping and feeding the recording material between said belt and said first image bearing member and between said belt and said second image bearing member in said first transferring portion and said second transferring portion, respectively, wherein said first image forming portion is disposed upstream of said second image forming portion with respect to a moving direction of the recording material, and a plurality of members including said first image bearing member and said second image bearing member are integrally assembled and are mountable on or dismountable from a main assembly of said image forming apparatus, and wherein the first developer is provided with a developer mother particle and a metallic soap adhered to a surface of the developer mother particle, and the second developer is provided with at least the developer mother particle from among the developer mother particle and the metallic soap, and wherein a first mass ratio of a mass of the metallic soap per unit mass of the first developer is greater than a second mass ratio of a mass of the metallic soap per unit mass of the second developer.

13. An image forming apparatus according to claim 12, wherein the first developer is provided with the metallic soap, and the second developer is not provided with the metallic soap.

14. An image forming apparatus according to claim 12, wherein said second image forming portion is not provided with a collecting member configured to collect foreign matter deposited on said second cleaning member.

* * * * *